US008185994B2

(12) United States Patent
Brackett et al.

(10) Patent No.: US 8,185,994 B2
(45) Date of Patent: May 29, 2012

(54) HAIRBRUSH, COMB AND MAKEUP BRUSH CLEANING DEVICE

(75) Inventors: Ted J. Brackett, Manhattan Beach, CA (US); C. Martin Smith, Los Angeles, CA (US)

(73) Assignee: Dynamic Cleaning Technologies LLC, Los Angeles, CA (US)

( * ) Notice: Subject to any disclaimer, the term of this patent is extended or adjusted under 35 U.S.C. 154(b) by 382 days.

(21) Appl. No.: 12/419,291

(22) Filed: Apr. 6, 2009

(65) Prior Publication Data

US 2010/0251494 A1 Oct. 7, 2010

Related U.S. Application Data

(63) Continuation of application No. 11/942,701, filed on Nov. 19, 2007, now Pat. No. 7,513,006, which is a continuation-in-part of application No. 11/225,318, filed on Sep. 12, 2005, now Pat. No. 7,296,319, which is a continuation-in-part of application No. 10/731,364, filed on Dec. 9, 2003, now Pat. No. 7,086,112, which is a continuation-in-part of application No. 10/002,365, filed on Nov. 1, 2001, now Pat. No. 6,666,925.

(60) Provisional application No. 60/245,078, filed on Nov. 1, 2000.

(51) Int. Cl.
*A46B 17/06* (2006.01)

(52) U.S. Cl. ..... 15/38; 15/39; 15/65; 15/76

(58) Field of Classification Search . 15/38; *A46B 17/06*
See application file for complete search history.

(56) References Cited

U.S. PATENT DOCUMENTS

| | | | | |
|---|---|---|---|---|
| 1,542,025 | A | 6/1925 | Ballman | |
| 2,082,991 | A | 6/1937 | Turco | |
| 3,761,984 | A | 10/1973 | Hauschild | |
| 4,912,797 | A * | 4/1990 | Brackett | 15/38 |
| 2006/0005332 | A1 * | 1/2006 | Brackett et al. | 15/38 |
| 2008/0066243 | A1 * | 3/2008 | Brackett et al. | 15/38 |

FOREIGN PATENT DOCUMENTS

WO WO90/11900 A1 10/1990

* cited by examiner

*Primary Examiner* — Monica Carter
*Assistant Examiner* — Stephanie Newton
(74) *Attorney, Agent, or Firm* — Law Office of David Hong

(57) ABSTRACT

The present invention thoroughly cleans hairbrushes and combs and comprises an upper portion with at least two openings for containing a hair remover and an item to be cleaned, a rotating roller brush, and a housing portion. The roller brush, together with the hair remover, effectively clean and remove hair from styling combs and brushes and prevent accumulated hair from impeding the cleaning action by removing it from the roller brush. The device is configured in a specialized concave crescent shape, and the pattern of bristles on the roller brush is configured to optimize cleaning action on hairbrushes and styling combs.

5 Claims, 20 Drawing Sheets

86
60
88
62a 62b
76
62a 86
60
80
82
78
84

86
62b
78
84
88

56a
62a 60
86
56a
56b
86

62a
60
80
82
78
84

86
88
88

76
68
70
72
64
74

FIG. 6A
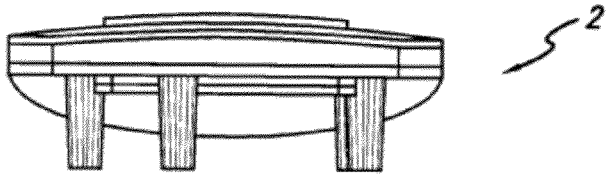
FIG. 6B
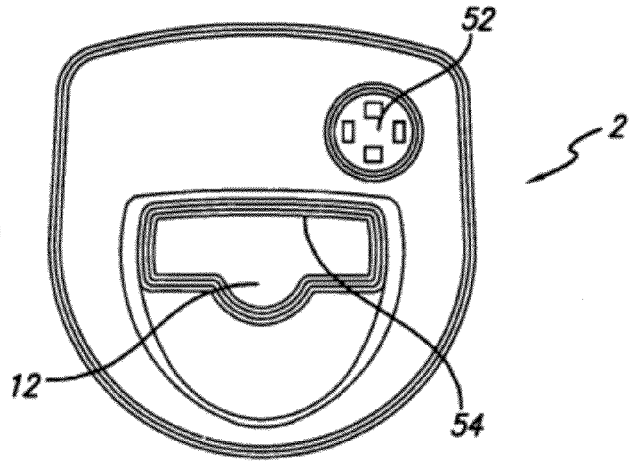
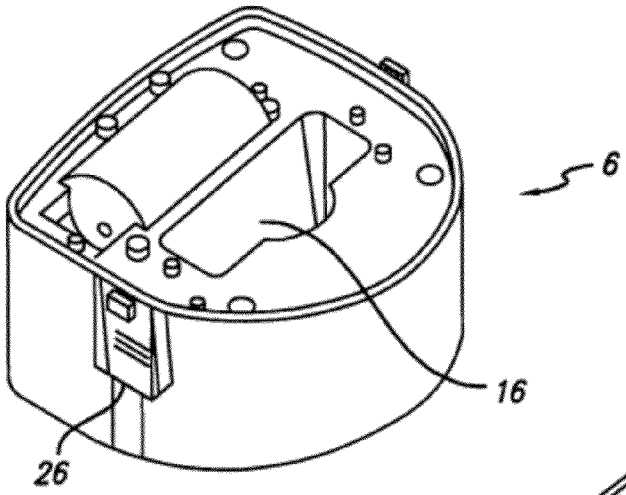
FIG. 7A
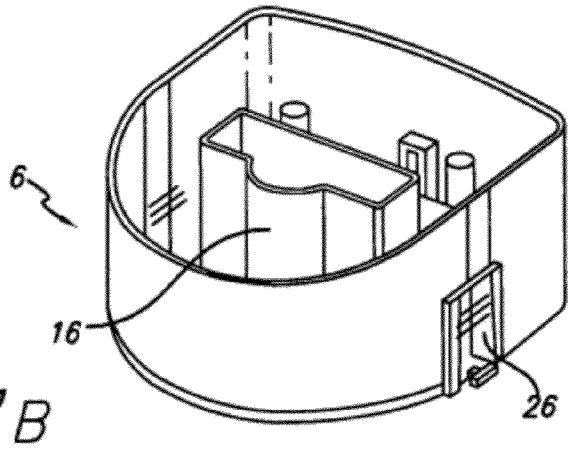
FIG. 7B

FIG. 18a
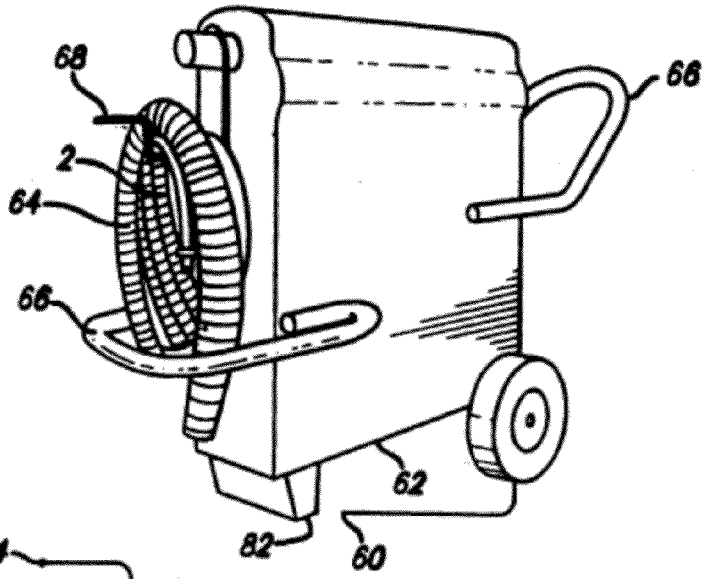
FIG. 18b
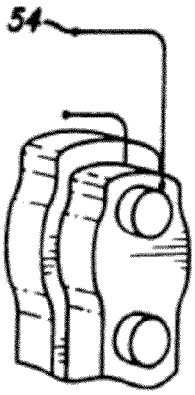
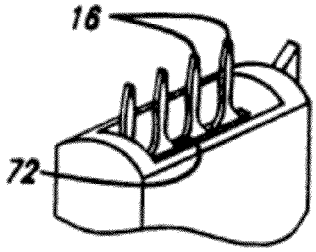
FIG. 18c

HAIRBRUSH, COMB AND MAKEUP BRUSH CLEANING DEVICE

CROSS-REFERENCE TO RELATED APPLICATIONS

This patent application is a continuation of U.S. patent application Ser. No. 11/942,701 (filed Nov. 19, 2007) and issues as U.S. Pat. No. 7,513,006 on Apr. 7, 2009, which is a continuation-in-part of U.S. patent application Ser. No. 11/225,318 (filed Sep. 12, 2005) and now U.S. Pat. No. 7,296,319 on Nov. 20, 2007, which is a continuation-in-part of and claims priority from U.S. patent application Ser. No. 10/731,364, filed Dec. 9, 2003, now U.S. Pat. No. 7,086,112, which is a continuation-in-part of and claims priority from U.S. patent application Ser. No. 10/002,365, filed Nov. 1, 2001, now U.S. Pat. No. 6,666,925, which claims priority from U.S. Provisional Patent Application No. 60/245,078 filed Nov. 1, 2000, which applications and patents are incorporated in their entirety herein by this reference thereto.

This application is related to U.S. Pat. No. 4,912,797, U.S. Design Pat. No. D458,720 and U.S. Design Pat. Application No. 29/203,394, now U.S. Design Pat. No. D516,257, also hereby incorporated by this reference.

COPYRIGHT AUTHORIZATION

A portion of the disclosure of this patent document contains material, which is subject to copyright protection. The copyright owner has no objection to the facsimile reproduction by any one of the patent disclosure as it appears in the U.S. Patent and Trademark Office patent files or records, but otherwise reserves all copyright rights whatsoever.

BACKGROUND OF THE INVENTION

Field of the Invention

The present invention relates generally to a cleaning device, and more particularly to a brush cleaning device that can be used to clean and sanitize hairbrushes, combs and cosmetic brushes.

SUMMARY OF THE INVENTION

The instant invention is directed to a cleaning device that incorporates optimized physical brushing action, water agitation, submersion and/or solution directional features to clean brushes, and which cleans, flushes and sanitizes hairbrushes, combs and cosmetic brushes. In the preferred embodiment, the Archimedes Screw principle of moving both fluid and particles in a determined direction is employed to remove hair, scalp debris and oils from both hairbrushes and combs.

In general, the device comprises a tank, brush frame and brush assembly, a motor housing and a top cover. The tank may have a substantially flat bottom and upraised sidewalls defining an interior or central space communicating with an open or partially open top, and is configured to contain water or cleaning solution. The tank may be comprised of a transparent or translucent material to allow the operator to observe the cleaning process, or it may comprise an opaque material. The top cover preferably comprises an opening, plurality of openings or throat opening, in which one or a plurality of brushes, cosmetic brushes, combs or hairbrushes can be inserted so that the bristle portion of each brush or comb to be cleaned and/or sanitized is optimally oriented in the device for cleaning.

In the preferred embodiment, the cleaning brush and the hair remover have, respectively, a specialized bristle and prong, pattern. The cleaning brush in the preferred embodiment rotates and is arranged, so that bristle-to-bristle (or bristle-to-prong in the case of combs) contact between the cleaning brush and the brush, comb, or cosmetic brush to be cleaned or sanitized, is optimal. In one version of the preferred embodiment, at least one rotating brush preferably comprises a bristle portion configured in a specialized densely packed pattern and/or a double radial spiral pattern about a support column, or "core".

In the preferred embodiment, rotation may be imparted to the rotating brush or brushes by, for example, an electric or battery operated motor, which engages one or more gears communicating with the rotating brush or brushes.

In the preferred embodiment, a tank receives water or other cleaning liquid and rotating brushes, or a combination of rotating and stationary brushes, are configured so that thorough cleaning and movement of the cleaning fluid can be accomplished without the need for injecting or pressurizing the cleaning liquid.

The device is self-contained, portable and lightweight and achieves thorough cleaning and/or sanitizing of brushes or combs without the need for hose connections or plumbing systems and permits several brushes or combs to be cleaned simultaneously. Water agitation and specialized cleaning means or brushes having a specialized pattern of bristles permits any brush, comb, hairbrush or cosmetic brush to be thoroughly cleaned or sanitized within about a minute or less without shaking, damaging, bending or rotating the brushes or combs themselves. The device may be used to clean brushes and combs used with oil-based as well as water-based makeup or hair preparations.

Various other features of the present invention are set forth in the following detailed description and accompanying drawings.

BRIEF DESCRIPTION OF THE DRAWINGS

FIG. 3(*b*) is a cutaway side view showing a hair brush and comb.

FIG. 3(*c*) is a side view of the hair remover.

FIG. 3(*d*) is a side cutaway view showing a styling comb and the hair remover.

FIG. 4(*b*) is a top plan view of the hairbrush and comb cleaning device according to a preferred embodiment of the invention.

FIG. 4(*c*) is a side view of the hair remover and a round brush according to a preferred embodiment of the invention.

FIG. 4(*d*) is a rear cutaway view of the hairbrush and comb cleaning device according to a preferred embodiment.

FIG. 4(*e*) is a side cutaway view showing the interior of the hairbrush and comb cleaning device according to a preferred embodiment of the invention.

FIG. 6(*a*) is a side view of the top cover of the brush-cleaning device according to an alternative embodiment of the present invention.

FIG. 6(*b*) is a top plan view of the top cover according to an alternative embodiment of the present invention.

FIG. 7(*a*) is a bottom perspective view of the motor housing according to an alternative embodiment of the present invention.

FIG. 7(*b*) is a top side perspective view of the motor housing according to an alternative embodiment of the present invention.

FIG. 8(*b*) is a side view of the tank according to an alternative embodiment of the present invention.

FIG. 8(*c*) is an enlarged view of the latch catch according to an alternate embodiment of the present invention.

FIG. 18(*a*) is a perspective side view of a second alternate embodiment of the present invention.

FIG. 18(*b*) is an enlarged view of the control knobs according to a second alternate embodiment of the present invention.

FIG. 18(*c*) is a side perspective view of the brush opening according to a second alternate embodiment of the present invention.

PARTS LIST FOR FIG. 19-25

Figure 1:
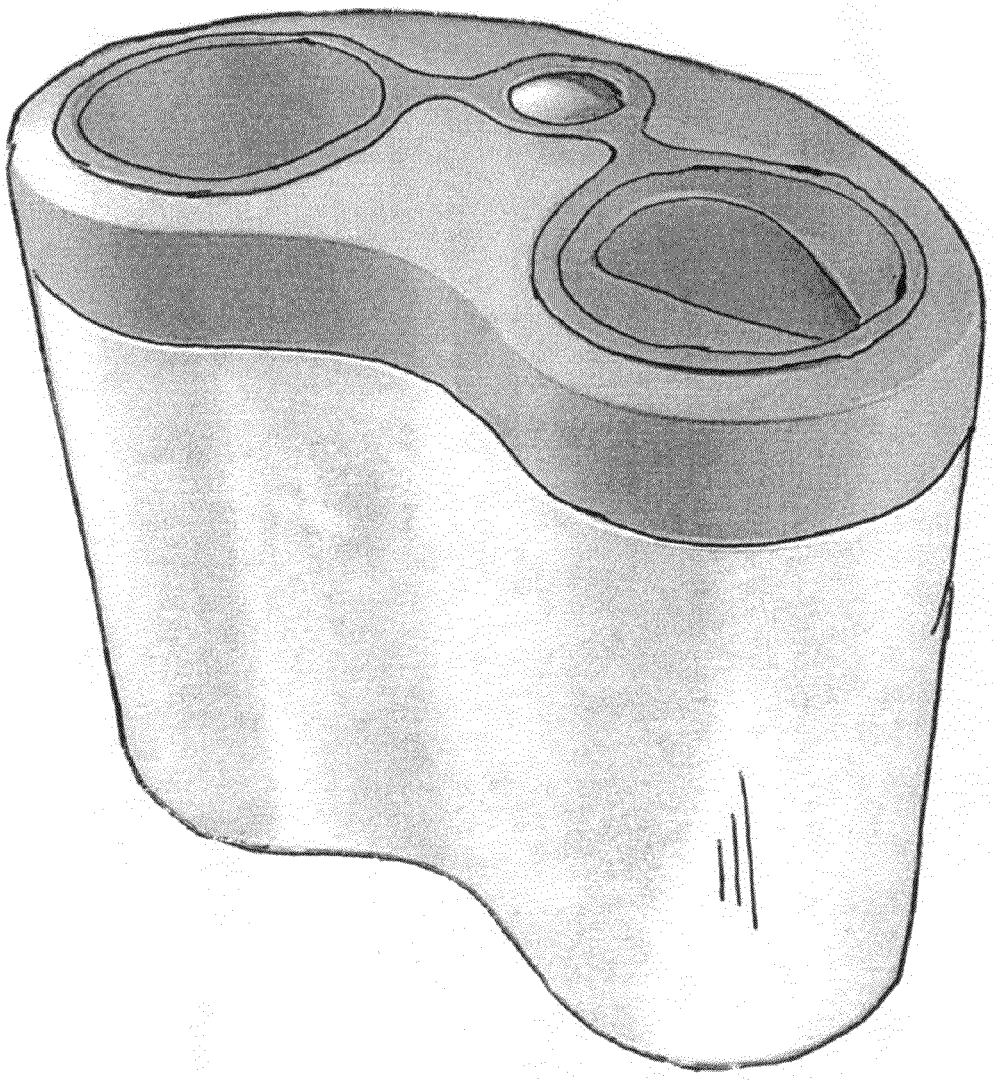
FIG. 1 is a front perspective view of the hairbrush and comb cleaning device according to a preferred embodiment.

200 Apparatus for cleaning brushes
205 Tank
210 Cover
215 Throat on Cover
220 Interior of Tank
225 Seal for Cover/Tank
230 Motor Housing
235 Motor Seal
240 Motor
245 Gear Train
250 Cylinder or Core for Roller Brush
255 Brush Cartridge
260 Cartridge Access Cap
265 Cartridge Access Cap Seal
270 On/Off button or activation button
275 Power Cord
280 Cleaning Solution
285 Boss on Gear Train
290 Comb Cleaner and opening
295 Axis for core and brush cartridge
300 Opening on Cover
305 Rotating Brush
310 Tuft of bristles
315 Bristle—first type
320 Bristle—second type
325 Ball Tip of second type of bristle
330 Tuft hole
335 First opening of tuft hole (0.08)
340 Second opening of tuft hole (0.16)
345 Axis of rotating brush

DESCRIPTION OF THE PREFERRED EMBODIMENTS

The detailed description set forth below in connection with the appended drawings is intended as a description of presently preferred embodiments of the invention and is not intended to represent the only forms in which the present invention may be constructed and/or utilized. The description sets forth the functions and the sequence of steps for operating the invention in connection with the illustrated embodiments. However, it is to be understood that the same or equivalent functions and sequences may be accomplished by different embodiments that are also intended to be encompassed within the spirit and scope of the invention. References to top/bottom, right/left etc. are relative terms provided for clarity and, unless otherwise noted, are interchangeable.

Figure 2:
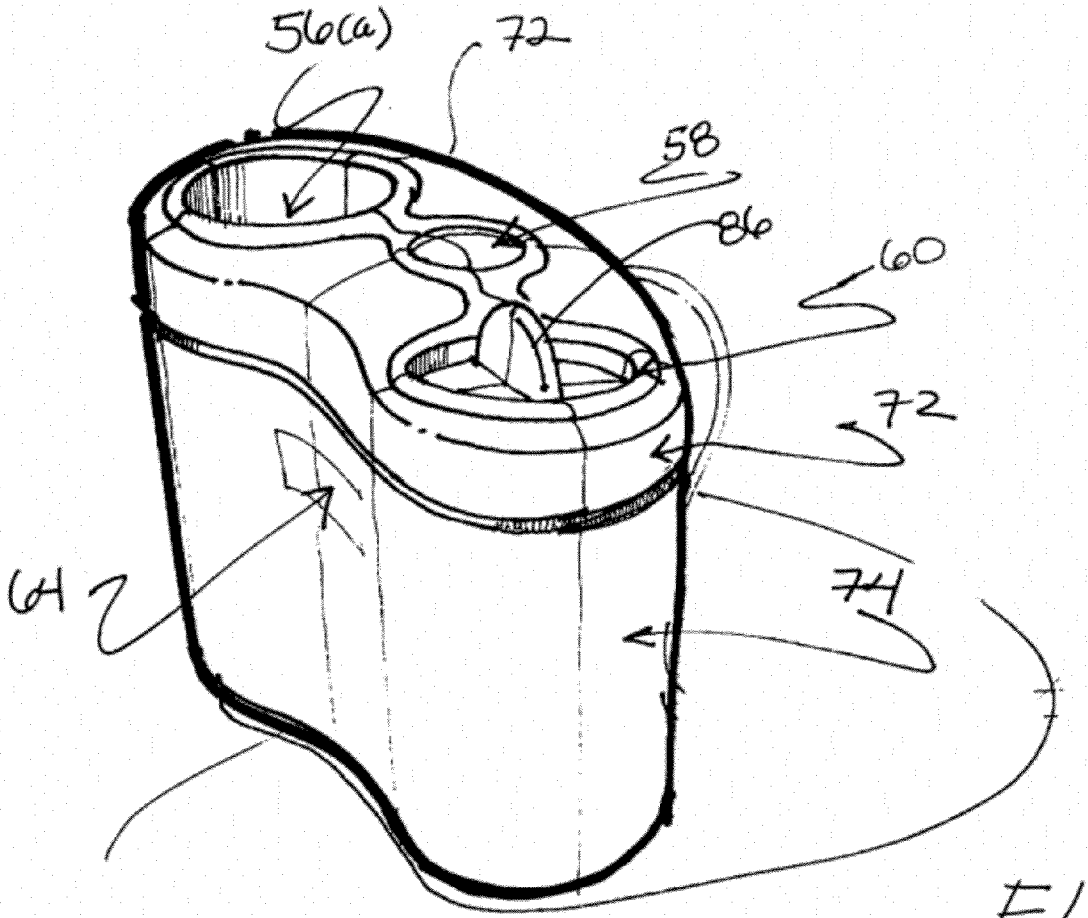
FIG. 2 is a front perspective view of the hairbrush and comb cleaning device according to a preferred embodiment of the invention.
Figures 3A, 3B, 3C, 3D:
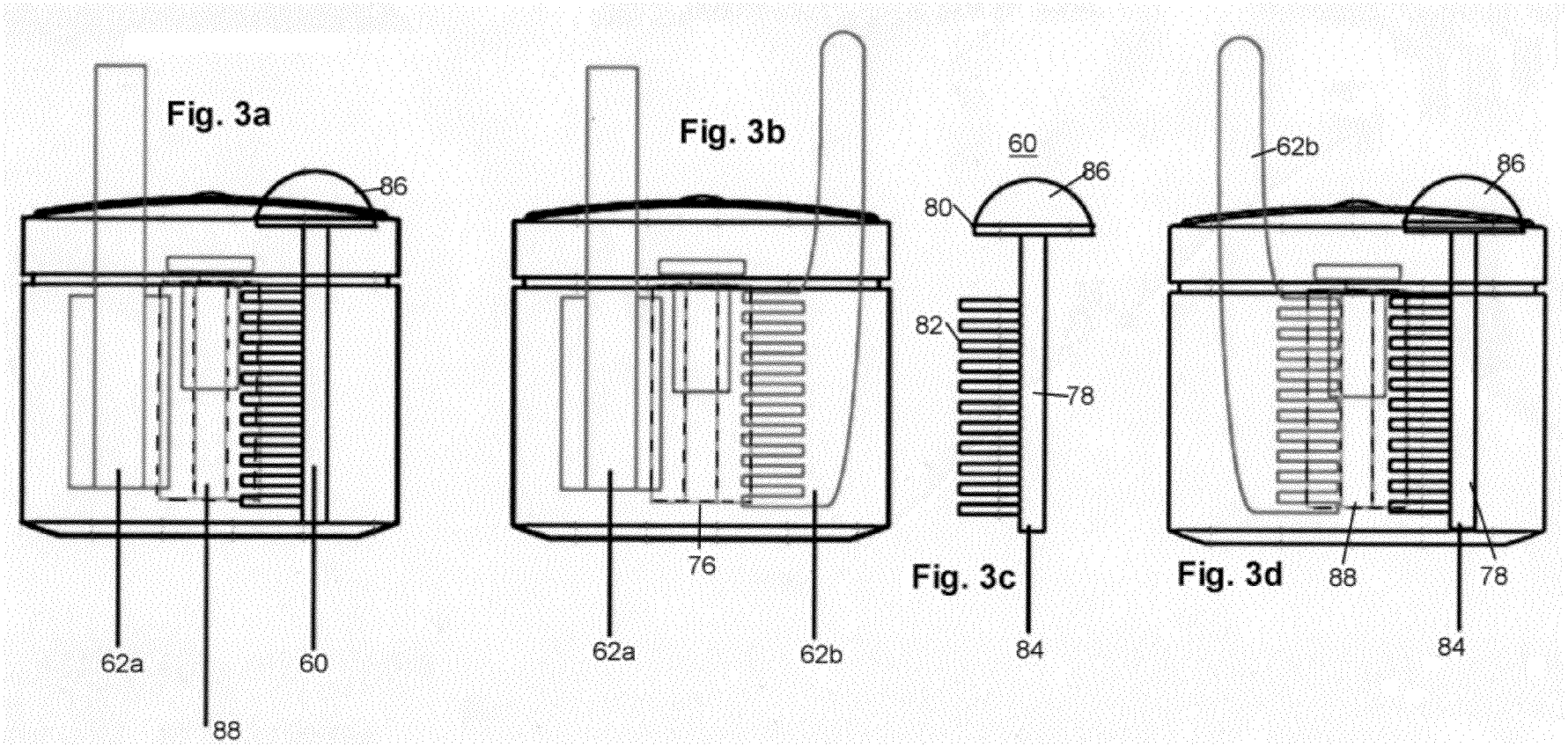
FIG. 3(*a*) is a cutaway side view of the hairbrush and comb cleaning device, showing the hairbrush and hair remover, according to a preferred embodiment of the invention.
Figures 4A, 4B, 4C, 4D, 4E:
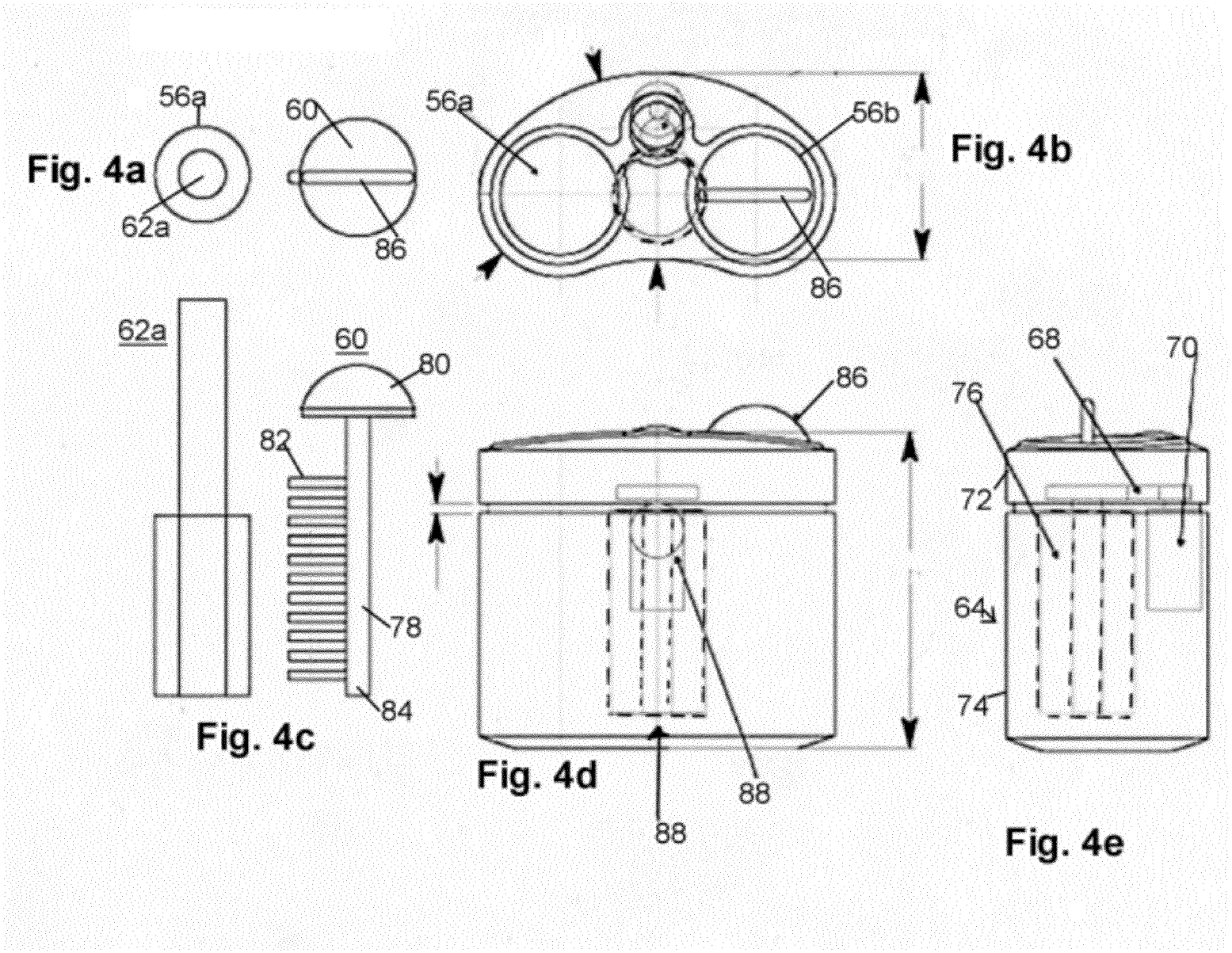
FIG. 4(*a*) is a top plan view of the openings containing a hairbrush for cleaning and the hair remover according to a preferred embodiment of the invention.

Referring to FIGS. 1-4 of the drawings, the device of the preferred embodiment generally comprises an upper portion 72 comprising a pair of openings 56(*a*), 56(*b*), a housing portion 74, a roller brush 76 and a hair remover 60 (FIGS. 2-4). In the preferred embodiment, the device 64 is configured so that the housing portion 74 (and preferably also the upper portion 72 so that the two portions are seated) is concave as shown in, by way of example only, FIGS. 1-2 and 4(*b*). The concave shape of the preferred embodiment, together with the movement of the roller brush 76, creates a "hydrodynamic swirl" or cyclone effect in the cleaning fluid forcing the cleaning fluid in a 360° motion around the item to be cleaned, further enhancing cleaning action. The first and second openings are preferably disposed on opposite sides of the roller brush and the device configured in a concave, or rounded crescent shape, so that the first and second openings may be disposed at each end of the rounded crescent shape to allow for optimal use of a swirling or cyclone effect for cleaning. The openings are in communication with the housing portion 74 and cleaning liquid contained in the housing portion 74.

The upper portion 72 and housing portion 74 may be comprised of a molded plastic material such as, for example, ABS plastic or high-density polyethylene plastic, but may be also be formed of other suitable materials such as steel, other metals or plastics, and also may be formed integral with each other or as separate removable units of the device.

In a first example of the preferred embodiment, and by way of example only, the height of the assembled upper portion 72 and housing portion 74 may be about 6 to 7 inches, the width about 3 to 4 inches, and the length about 7 to 8 inches, although other dimensions of the device may be suitable. In the preferred embodiment, the device 64 is space conscious and configured to be portable and to take up only a small footprint on a counter top, a salon bench or other work area. In the preferred embodiment, the device 64 comprises round or semi-round openings 56(*a*), 56(*b*) sized to permit cleaning of all types of round and square hair brushes and different comb sizes and configurations.

In the preferred embodiment, the hair remover 60 comprises a column 78, a plurality of prongs 82, a bottom end 84 and a top end 80 comprising an edge 86 for grasping with the fingers. The hair remover 60 operates by turning prongs 82 that are preferably specifically spaced and sized, directly into the roller brush 76 while the roller brush 76 is in the "on" position.

The roller brush 76 and hair remover 60 are preferably disposed in approximate parallel relation to one another when the hair remover 60 is disposed in the housing portion 74. In one version, the hair remover 60 makes direct contact with the roller brush 76 at an angle of about 20 to about 30 degrees, which permits optimal hair removal from the roller brush 76 down to the surface of the core 88. In this version, the hair remover 60 makes contact with the core 88 of the roller brush 76 at a set angle to force loose hair onto the hair remover 60, but without causing "skipping" or interruption of the rotating mechanism, which in the preferred embodiment may comprise a motor 70 powered by a 110 AC or 12 V DC power supply, and a gearbox 68.

In the preferred embodiment, the roller brush 76 optimally rotates at about 300 RPM, although other speeds, such as from about 100 RPM to about 400 RPM may be suitable depending upon the items to be cleaned, size and configuration of the device 64.

In another version of the preferred embodiment the roller brush 76 and hair remover 60 are spaced slightly so that they do not touch. In this version, the hair remover may be set at an angle to optimize hair removal from the roller brush 76. For example, the hair remover 60 may be set at an angle of about 20 degrees to about 30 degrees in relation to the roller brush 76. To operate the device 64, the operator inserts a styling comb 62(*b*) or hairbrush 62(*a*) to be cleaned into openings 56(*a*) and/or 56(*b*). The operator may then press the on/off button 58 to power the motor 70. Motor 70 preferably communicates with a gearbox 68 to impart rotation to roller brush 76, which cleans the hairbrush 62(*a*) and/or styling comb 62(*b*).

If operated with the hair remover 60 in opening 56(*b*), the hair remover 60 may be removed to discard the hair and debris removed from the hairbrush 62(*a*) or styling comb 62(*b*). To remove the hair remover 60 from the device, the operator may grasp the edge 86 and rotate and pull the hair remover 60 out of the hairbrush, comb and makeup cleaning device 64 so that accumulated hair from cleaning brushes 62(*a*) or styling combs 62(*b*) can be removed. Once the hair remover 60 is out of the device 64, the operator may remove the hair from the hair remover 60 by tapping or shaking over a waste receptacle. The device 64 permits thorough cleaning of hairbrushes and styling combs without the need to manually pull hair from the hairbrush 62(*a*) or styling comb 62(*b*) itself and without compromising cleaning performance of the roller brush 76 that might occur from accumulated hair from the hairbrush 62(*a*) or styling comb 62(*b*) to be cleaned.

In the preferred embodiment of the invention, the openings 56(*a*), 56(*b*) are configured so that the roller brush 76 sits between them and so that they receive respectively a hairbrush or styling comb to be cleaned 62(*a*), 62(*b*) and/or the hair remover 60. In a first version of the preferred embodiment, the roller brush 76 sits between openings 56(*a*) and 56(*b*), which contain respectively, a hair brush to be cleaned 62(*a*) and a hair remover 60. In a second version of the preferred embodiment, the device operates with a styling comb 62(*b*) in one of the openings 56(*a*), 56(*b*) and a hair brush 62(*a*) to be cleaned in the other opening. In a third version of the preferred embodiment, a styling comb 62(*b*) to be cleaned is placed in one of the openings 56(*a*), 56(*b*) and the hair remover 60 is placed in the other opening.

In an alternate roller brush 76 configuration, the device 64 may comprise at least two roller brushes 76 that comprise a spiral brush pattern and which are spaced so that they do not touch. In the alternate version, a first roller brush contacts the styling comb or hairbrush to be cleaned and a second roller brush is configured to catch and remove accumulating hair and debris as it accumulates on the first roller brush.

In the preferred embodiment, the housing portion 74 is filled with cleaning fluid and the device 64 employs agitation of the fluid by the roller brush 76 and bristle-to-bristle contact with the hairbrush 62(*a*) or styling comb 62(*b*) to pull, lift and whisk away hair and epidermis debris and oils from the hairbrush 62(*a*) or styling comb 62(*b*). Vibration or sonic action and aeration of the cleaning fluid may also be employed in the instant invention to enhance cleaning of the hairbrush 62(*b*), styling comb 62(*b*) or other item to be cleaned by creating an active cleaning environment further removing hair, dirt, debris and oils from the items to be cleaned. In one version of the preferred embodiment, the roller brush and roller brush bristles are configured to create optimal aeration of the cleaning fluid. In one version of the preferred embodiment, the opening 56(*b*), roller brush 76 and hair remover 60 are configured and spaced so that the roller brush 76 and hair remover do not touch and are preferably spaced from one another. By way of example, the end tips of the tufts 34 of the bristle portion of the roller brush 76 may be spaced from about 0.05 cm to about 5.0 cm from the hair remover 60.

In a first example of an alternate embodiment, the top cover 2 may have a length of preferably approximately 10 cm to about 200 cm, is more preferably from about 25 cm to about 150 cm in length, and is most preferably approximately 50 cm to about 100 cm in length, or about 78 cm in length. The top cover 2 may be preferably between about 25 cm wide to about 250 cm wide, is more preferably about 50 cm to about 200 cm wide, and is most preferably between about 100 cm to about 175 cm or, about 152 cm wide. The top cover preferably has a depth of between about 25 cm to about 250 cm, is more preferably about 50 cm to about 200 cm deep, and is most preferably between about 100 cm to about 175 cm deep, or about 152 cm deep. The dimensions, however, may be varied depending upon the desired cleaning application. The top cover 2 in the preferred embodiment comprises a tongue opening 12 on its upper surface (FIG. 6(*a*)). In the preferred embodiment, a tongue 16 may be continuous with the tongue opening 12 and project downward from the tongue opening 12 toward the brush housing 6 from the rear face of the top cover 2. Alternately, the tongue 16 may be continuous with or attached to the motor housing 6 and project upwards towards the tongue opening 12 and top cover 2 (FIGS. 7(*a*), 7(*b*)).

In the alternate embodiment, the tank 10 comprises a bottom 48 and walls 11 defining an interior 13 and has top opening 15. The tank 10 is preferably comprised of polyethylene or an equivalent, although various materials such as metals and other plastics will be suitable.

Figure 5:
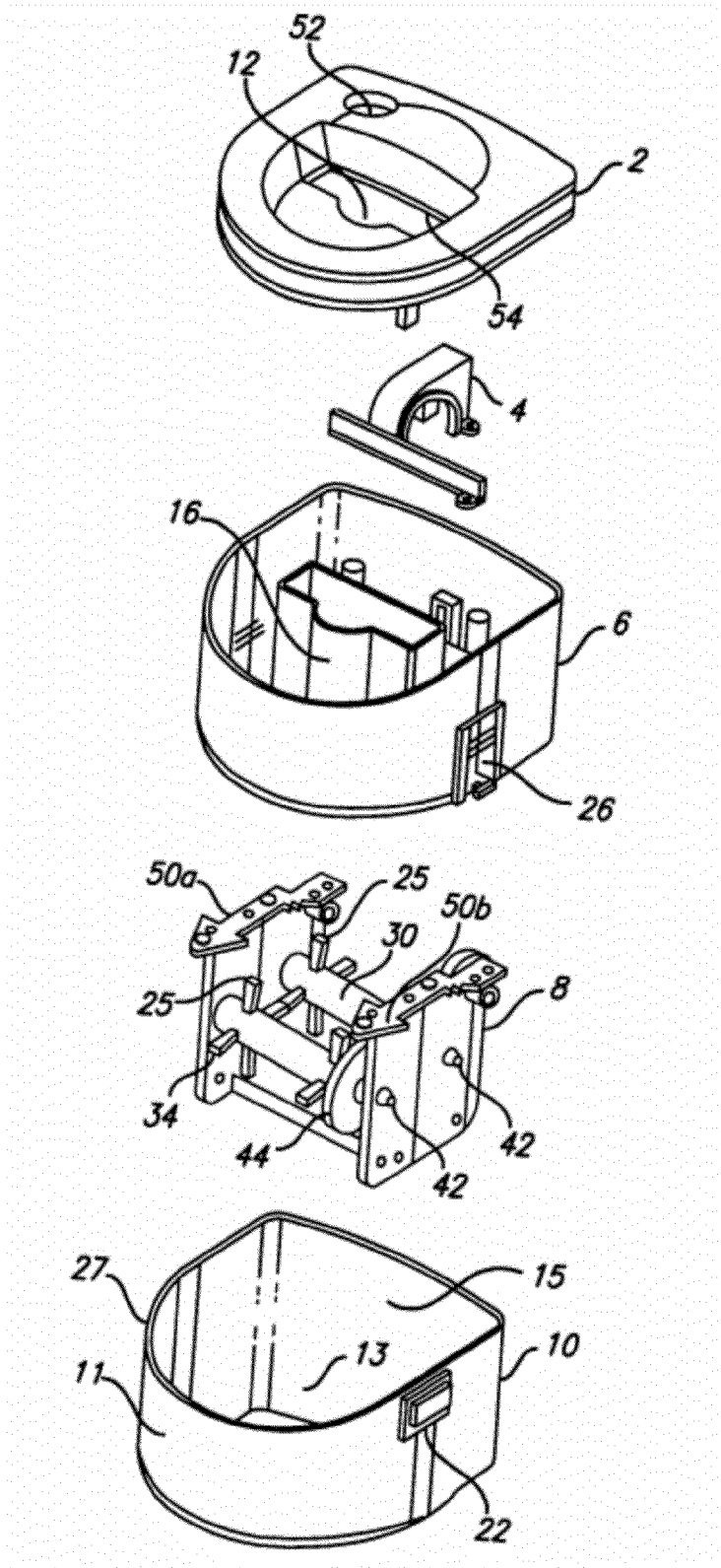
FIG. 5 is an exploded perspective side view of the top cover, motor cowling, motor housing, brush assembly and tank components of the device according to an alternative embodiment of the present invention.

The motor housing 6, in the alternate embodiment, is preferably configured to interface with the brush frame 8 at one end such as its lower end, and with the top cover 2 at its upper, or opposite end (FIG. 5). By way of example only, in Example I, the motor housing 6 is preferably approximately between about 25 cm to about 250 cm high, is more preferably between about 50 cm to about 200 cm high, and is most preferably between about 75 cm to about 150 cm high, or about 79 cm high.

In Example I, the motor housing 6 is preferably between about 25 cm to about 300 cm wide, is more preferably between about 50 cm to about 200 cm wide and is most preferably between about 75 cm and about 150 cm wide, or about 154 cm wide. In Example I, the motor housing 6 is preferably between about 25 cm to about 300 cm deep is more preferably between about 50 cm to about 200 cm deep and is most preferably between about 100 cm to about 175 cm deep, or about 153 cm deep.

The motor housing 6 may be comprised of ABS molded plastic, although other materials such as metals and other plastics will be suitable. In the preferred embodiment, a motor cowling 4 secures a motor (not shown) in place in the motor housing 6 to drive the rotating brushes 30 and also serves to cool the motor by permitting the circulation of air from inside and outside of the motor housing 6.

Figure 9:
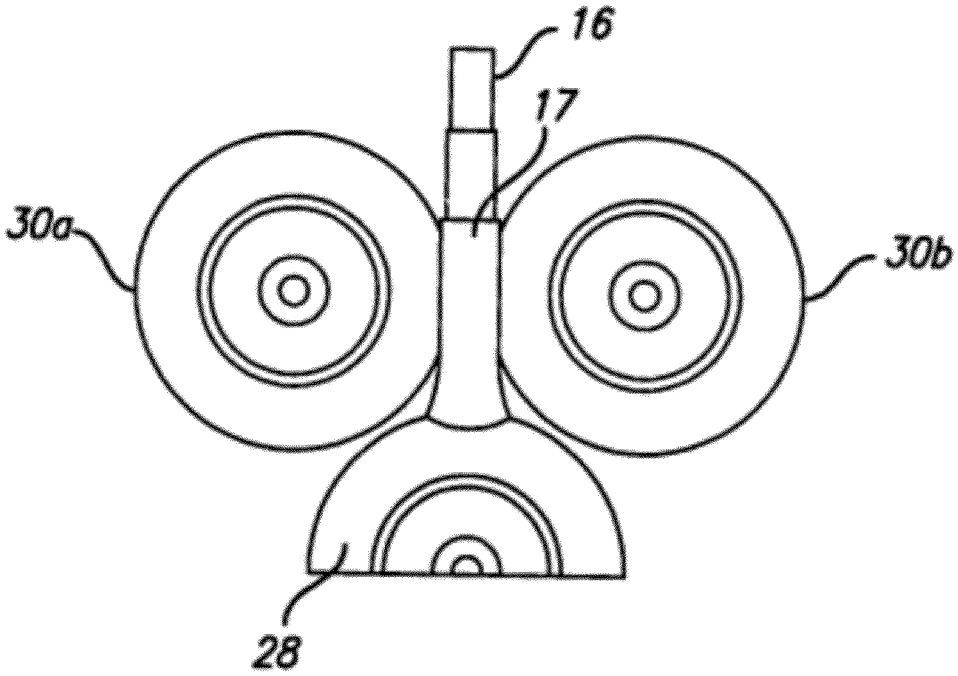
FIG. 9 is a side view of the cleaning brush arrangement according to an alternative embodiment of the present invention.
Figure 10:
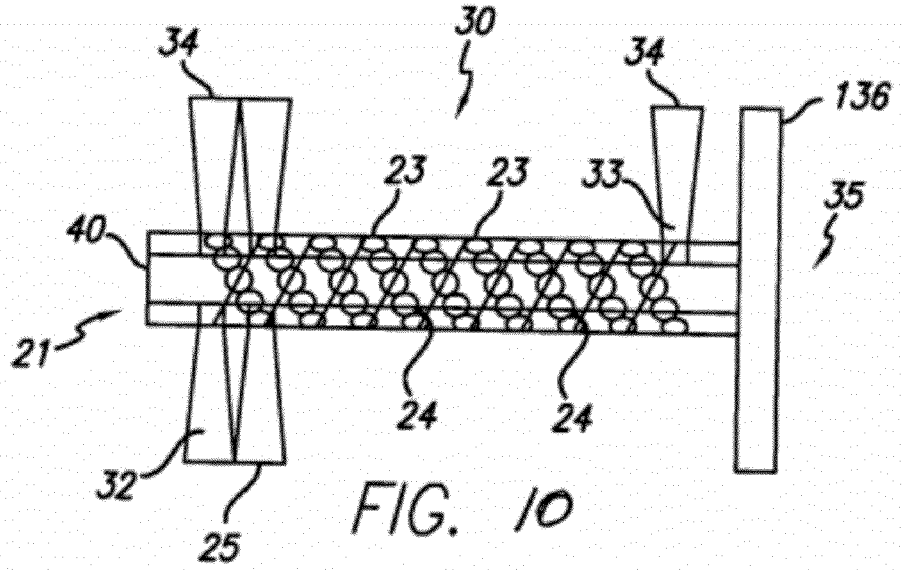
FIG. 10 is a side view of the rotating brush showing a spiral bristle pattern and representative bristle tufts
Figure 11:
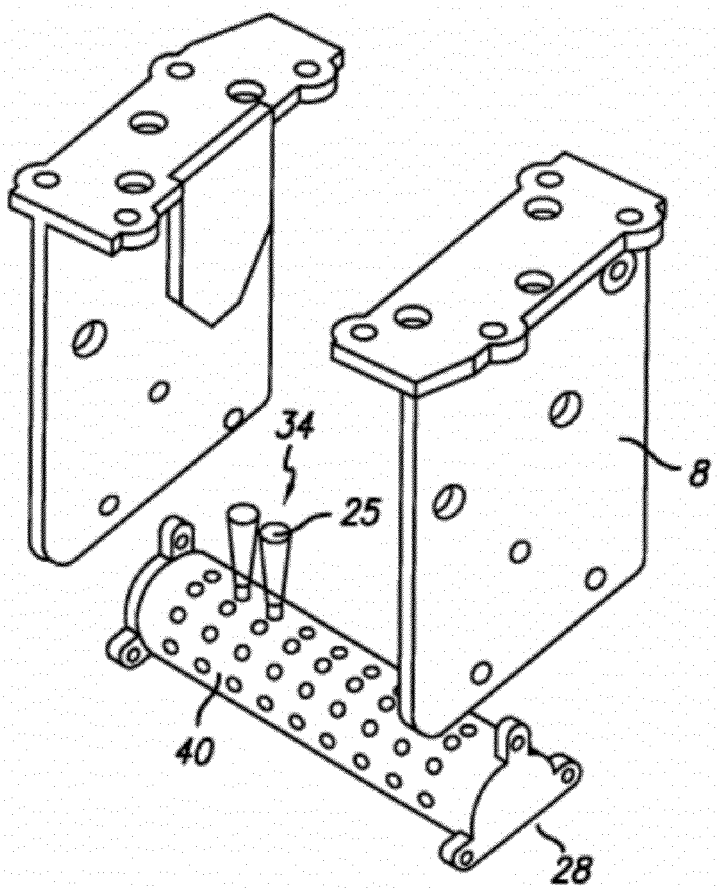
FIG. 11 is an exploded view of a portion of the brush assembly that interfaces with the stationary brush in an alternative embodiment of the present invention.
Figure 12:
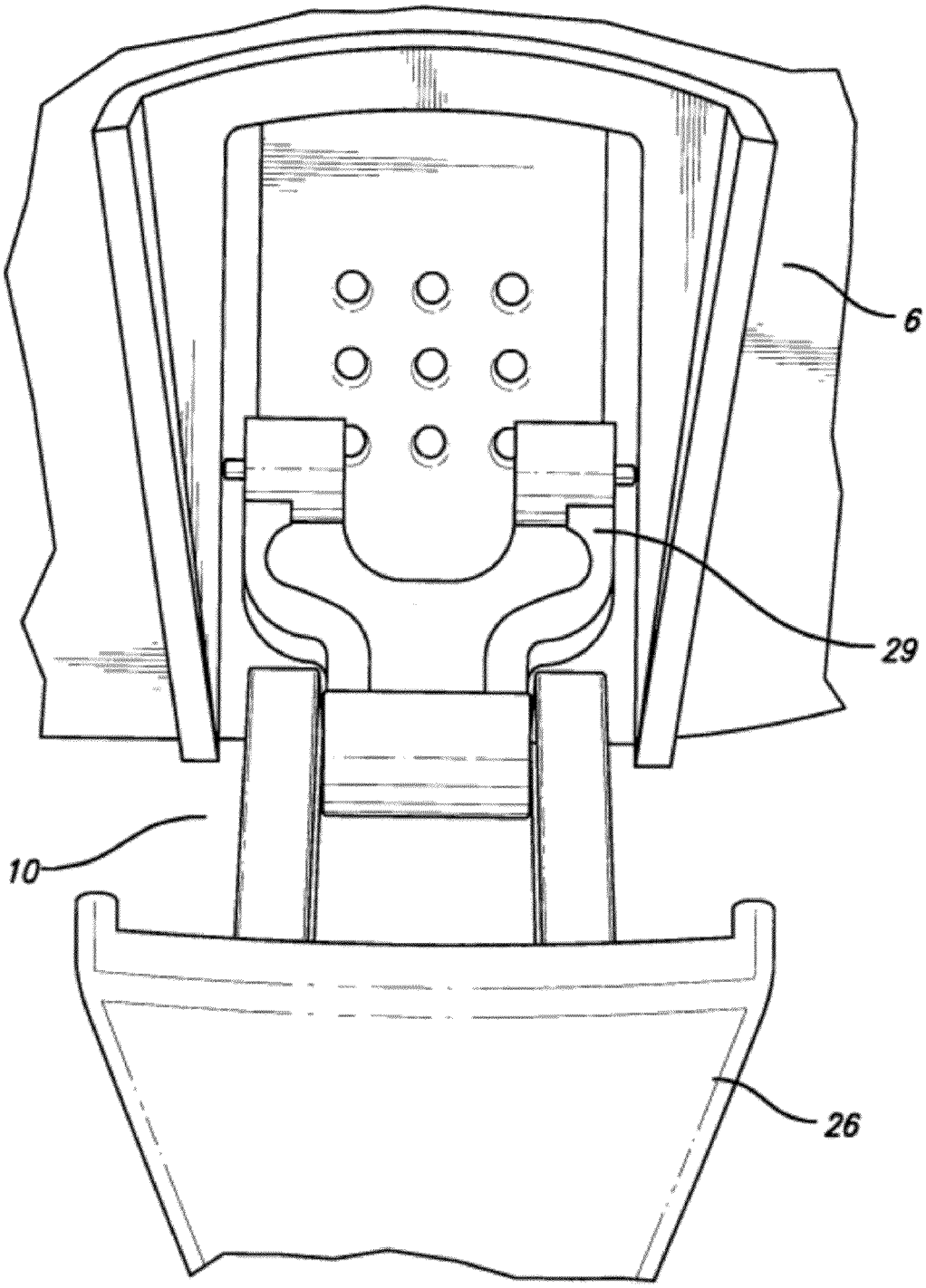
FIG. 12 is an enlarged view of the latch configuration according an alternative embodiment of the present invention.
Figure 13:
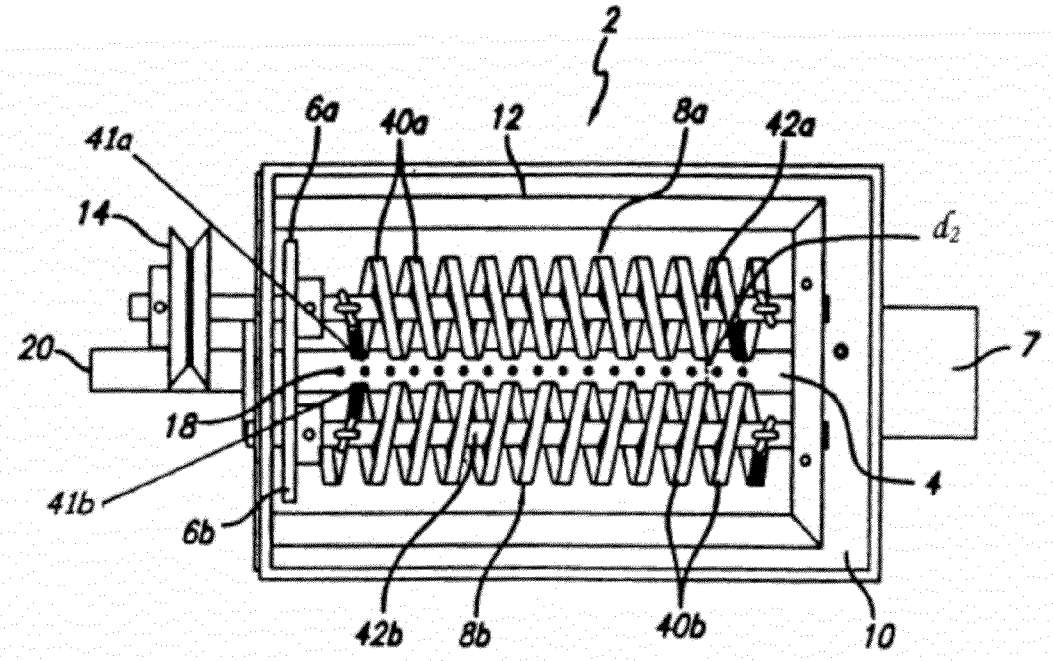
FIG. 13 is a top view of a second alternate embodiment of the brush-cleaning device of the present invention.
Figure 14:
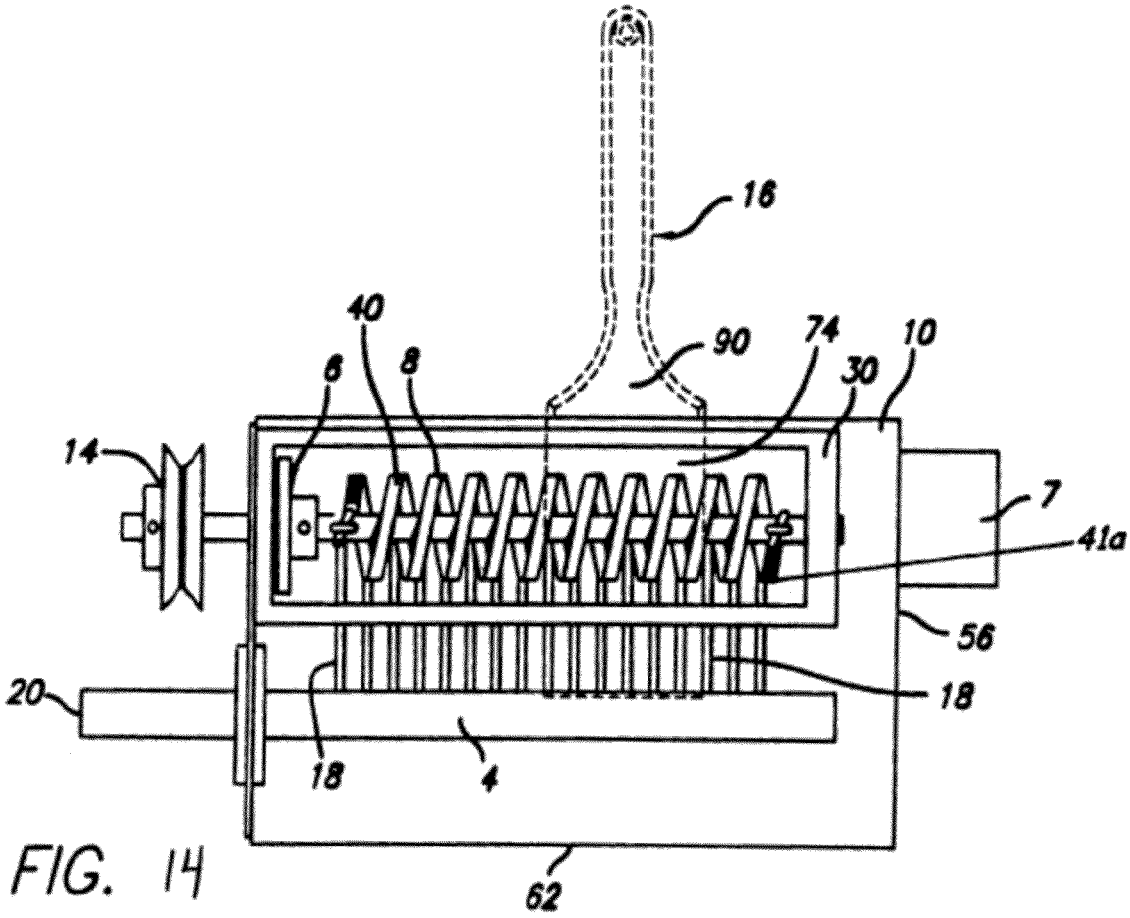
FIG. 14 is a cut-away side view of a second alternate embodiment of the brush-cleaning device of the present invention.
Figure 15:
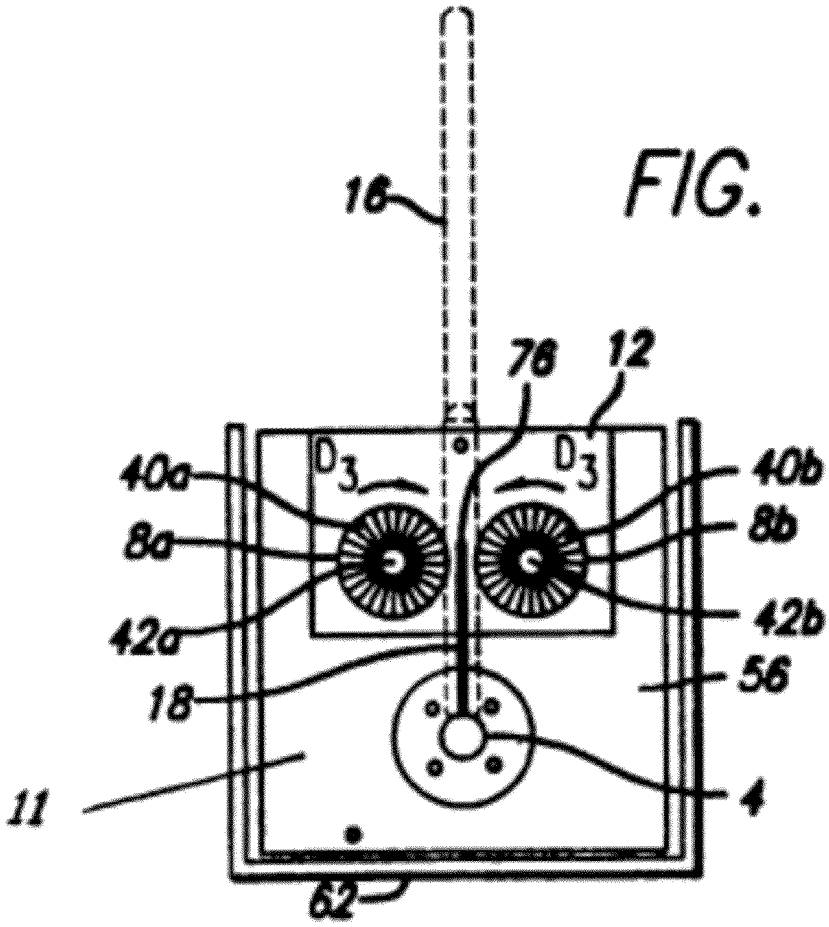
FIG. 15 is a cross-sectional front view according to a second alternate embodiment of the brush-cleaning device of the present invention.
Figure 16:
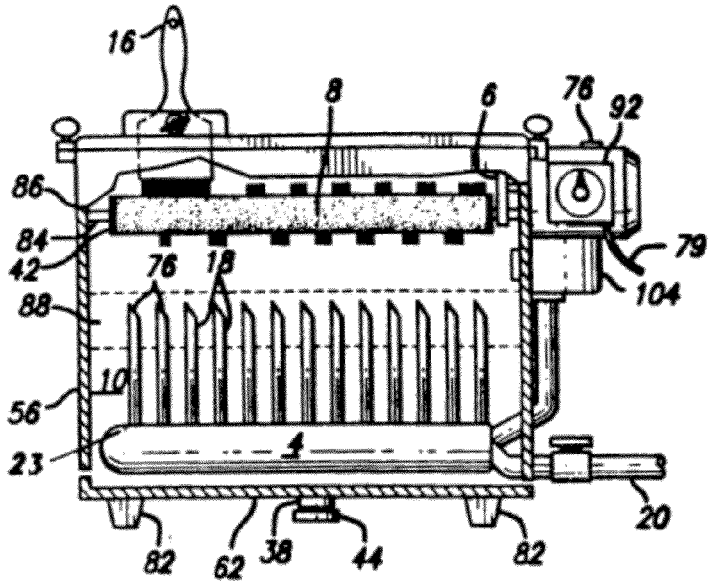
FIG. 16 is a side cutaway view of the cleaning brush and nozzles according to a second alternate embodiment of the present invention.
Figure 17:
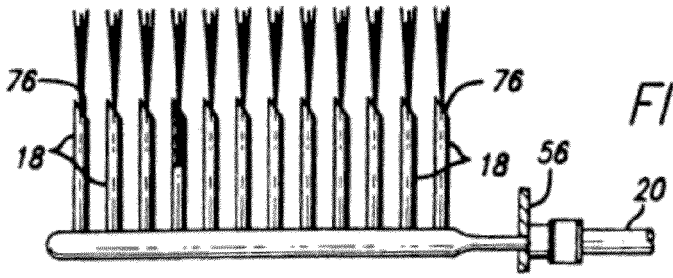
FIG. 17 is a side view of the nozzle and manifold configuration according to a second alternate embodiment of the present invention.

In one version of the alternate embodiment, the brush frame 8 preferably comprises a set of three (3) cleaning brushes, including a stationary brush 28 and two (2) rotating brushes 30(*a*) and 30(*b*) (see FIGS. 9, 11). The stationary brush 28 and rotating brushes 30*a*, 30*b* are preferably configured in an inverted triangle arrangement with the rotating brushes 30*a*, 30*b* being disposed parallel to one another and above the stationary brush 28. The stationary brush 28 may be disposed between the lower ends of the brush frame 8 such that it serves as a structural support to the brush frame 8 (see e.g. FIG. 11). In one variation of the alternate embodiment, the device comprises three rotating brushes in an inverted triangle pattern. In another variation of the alternate embodiment, the device comprises a single pair of rotating brushes, and in a third variation of the alternate embodiment, the device comprises a pair of brushes including one rotating and one stationary brush. Additional brush configurations may be used, depending upon the desired application.

In the preferred and alternate embodiments, the stationary and rotating brushes 30*a*, 30*b*, 28 of the alternate embodiment and the roller brush 76 of the preferred embodiment may each comprise a bristle portion 21, which in turn comprises individual tufts. The stationary brush 28 and rotating brushes 30*a*, 30*b* each preferably comprise a support column and the roller brush 76 preferably comprises core 88. The bristle portion 21 is preferably disposed along the length of the support column 40 and of core 88. The size, density and pattern of the tufts 34 as arranged in the bristle portion of the stationary brush 28 and rotating brushes 30 and of the roller brush 76 are preferably configured to provide optimal bristle-to-bristle contact between the cleaning brushes (the stationary brush 28 and rotating brushes 30*a*, 30*b*) or the roller brush 76 and the brush, comb or other item to be cleaned or sanitized.

In the preferred embodiment and alternate embodiments, at least a portion of the tufts 34 may be preferably cone-shaped, with the wide portion 32 of the cone preferably disposed distal to the support column 40 or core 88. The tufts 34 are preferably arranged along the brush support column 40 or core 88 to achieve a maximum tight pattern. In a first Example ("Example I"), individual tufts 34 may be disposed in the brush support column 40 or core 88 in tuft holes 23, and are preferably spaced such that the walls 24 between adjacent tuft holes 23 are approximately from about 0.0001 mm thick to about 0.01 mm thick, are more preferably about 0.0005 mm thick to about 0.005 mm thick, and are most preferably approximately 1/100,000 inch or about 0.000250 mm in thickness. Alternately, or in addition to the bristle density pattern of the tufts 34, the tufts 34 may be disposed in a spiral pattern, or double spiral pattern along the support column 40 or core 88 for maximum density, which may be enhanced by using a closed wound pattern with an approximately zero pitch.

Where the rotating brush 30, or stationary brush 28 if present, or the roller brush 76 comprise a spiral pattern of tufts 34 about the length of the rotating 30 or stationary brush 28 or roller brush 76, the spiral pattern is preferably disposed along substantially the entire length of the cleaning brushes 28, 30*a*, 30*b* or roller brush 76 and may be at an approximately 20-degree to about 45-degree, and most preferably at an approximately 30-degree angle, to the long axis 35 of the support column 40 or core 88 for optimal cleaning, although other angles may be suitable. The diameter of the tufts 34 at the tuft base 33 in Example I is preferably approximately 0.005 cm to about 5.0 cm, is more preferably between approximately 0.01 cm and about 1.0 cm, and most preferably, is between about 0.015 cm and about 0.25 cm in diameter (or about 0.1 inch to about 0.005 inch), or approximately 0.08 cm, in diameter. In Example I, the diameter of the distal portion 34 of the tufts is preferably slightly larger than that of the tuft base 33 so that the tuft 34 forms a cone shape.

In Example I of the alternate embodiment, the tufts 34 are preferably approximately 0.5 cm to approximately 25 cm in length, are more preferably approximately 0.75 cm to approximately 10 cm in length, and are most preferably, approximately 1 to approximately 5 cm, or approximately 2.5 cm (about one inch) in length. In one version, the bristle portion 21 is configured so that the cleaning fluid is transported upwards towards and through the brush, hairbrush 62(*a*), comb 62(*b*) or other item to be cleaned via the spiral pattern on the cleaning brush(es) or roller brush 76 and the Archimedes screw principle.

In one variation of the alternate embodiment, the rotating brushes 30 are preferably held in the brush frame 8 by way of a drive shaft 42 and support column 40, wherein the drive shaft 42 preferably attaches to the brush frame 8 and sits within the support column 40 to support the rotating brushes 30 (FIG. 5). The drive shaft 42 is preferably arranged concentrically in the support column 40 of the rotating brushes 30. The stationary brush 28, if present, may also comprise a support column 40, and may be held securely to the brush frame 8 by suitable means known in the art, such as by screws or other suitable fasteners that secure the stationary brush support column 40 to the brush frame 8.

By way of example only, in Example I, the rotating brush 30 or brushes 30*a*, 30*b*, in an artist brush or cosmetic brush application, may be from approximately 50 cm to about 300 cm long, are more preferably from about 75 cm to about 150 cm long, and are most preferably between about 85 cm and about 100 cm long, or about 97 cm long. In Example I, the support column 40 may be from about 5.0 cm to about 100 cm in diameter, is more preferably from about 10 cm to about 75 cm in diameter, and is most preferably between about 40 cm and about 60 cm, or about 51 cm in diameter. The support column in Example I of the preferred embodiment may comprise a drive shaft 42 along the length of the support column 40, the drive shaft 42 in Example I preferably being from about 1.0 cm to about 95 in diameter, is more preferably from about 5.0 cm to about 50 cm in diameter, and is most preferably between about 10 cm and about 30 cm in diameter, or about 17 cm in diameter.

The drive shaft 42 in Example I of the preferred embodiment is preferably approximately 5.0 cm to about 250 cm long, is more preferably about 50 cm to about 150 cm, and is most preferably between approximately 75 cm to approximately 120 cm long, or about 115 cm long. In Example I, the stationary brush 28, if present, may be approximately 10 cm to about 300 cm long, is more preferably about 50 cm to about 150 cm long, and is most preferably about 75 cm to 120 cm long, or about 100 cm long. The stationary brush 28, if present, may be about 10 cm to about 150 cm in diameter, is more preferably about 20 cm to about 100 cm in diameter, and is most preferably about 40 cm to about 75 cm, or about 50 cm in diameter In the alternate embodiment, the rotating brushes 30, where two brushes are present, do not touch, and the stationary brush 28, if present, preferably does not touch the rotating brush(es) 30. In the alternate embodiment, the distal ends 25 of the tufts 34 of the respective rotating brushes 30 do not touch, and the distal ends 25 of the tufts 34 of the stationary brush 28, if present, preferably do not touch the distal ends 25 of the tufts 34 of the rotating brush(es) 30.

In Example I, the rotating 30 brush and the stationary brush 28, if present, are preferably disposed in a brush frame 8 preferably having a height of approximately about 5 cm to about 200 cm, more preferably of about 25 cm to about 150 cm in height, and most preferably have a height of about 75 cm to about 120 cm, or approximately 90 cm in height. The brush frame 8 in Example I preferably has a width of approximately about 1.0 cm to about 200 cm, more preferably has a width of about 5 cm to about 100 cm, and most preferably has a width of about 10 cm to about 30 cm, or about 12 cm. The brush frame 8 in Example I preferably has a depth of approximately about 10 cm to about 250 cm, more preferably is between approximately 150 cm to approximately 25 cm in depth, and is most preferably from about 75 cm to about 125 cm in depth, or about 90 cm in depth.

In the preferred embodiment and the alternate embodiment, the support column 40 or core 88 of at least one of the rotating brushes 30 or the roller brush 76 may comprise at least one gear 44, which may be located in a gearbox 68, which directly or indirectly interfaces with a power source. The power source may comprise an electric or battery operated motor 70, a manual hand crank (not shown), or devices comprising a paddlewheel or operating on hydrodynamic principles, such as, for example, those where the kinetic energy of a jet of water is transformed into power at the shaft of the paddle of a paddlewheel. In the alternate embodiment, the rotating brush(es) 30 turn as power is applied to the gear 44 and in the preferred embodiment, applying power to motor 70, preferably causes gears in gearbox 68 to impart rotation to roller brush 76. In the alternate embodiment, it is preferable that the gears and power source are configured so that the rotating brush(es) 30 are each turned inward toward the paintbrush, artist brush arts & crafts or cosmetic brush to be cleaned or sanitized. The brush cleaning device may also be operated without a motor, hand crank, paddlewheel or similar power source, such as by using the operator's up and down and/or sideways motion of the paintbrushes, cosmetic brushes or arts & crafts brushes to be cleaned with a pair of stationary brushes.

In Example I, the drive gear 44 is preferably about 5 cm to about 150 cm in diameter, more preferably is about 10 cm to about 100 cm in diameter, and is most preferably about 20 cm to about 50 cm in diameter, or approximately 35 cm in diameter. In Example I, a suitable motor, if present, may be a 12 v electric motor with counter clockwise rotation with a speed of approximately 20600 rpm and a torque of approximately 49.4 mN-m, or other suitable motor known in the art. In one version of an alternate embodiment, the stationary brush 28 and rotating brushes 30 are configured so that the operator's up and down movement of the paintbrush or cosmetic brush in the device replaces the power source, such as the motor or hand crank.

Figure 8A:
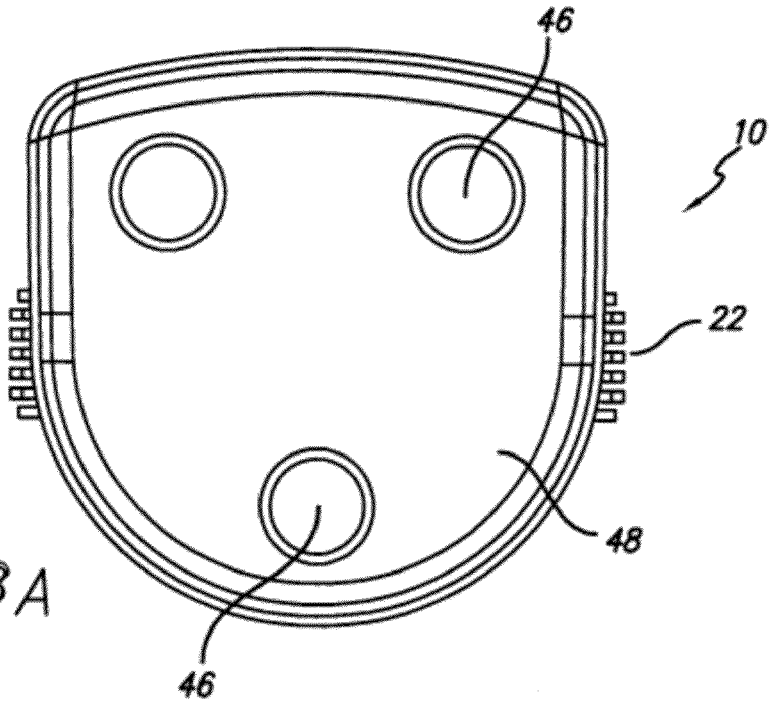
FIG. 8(*a*) is a bottom plan view of the tank according to an alternative embodiment of the present invention.
Figure 8B:
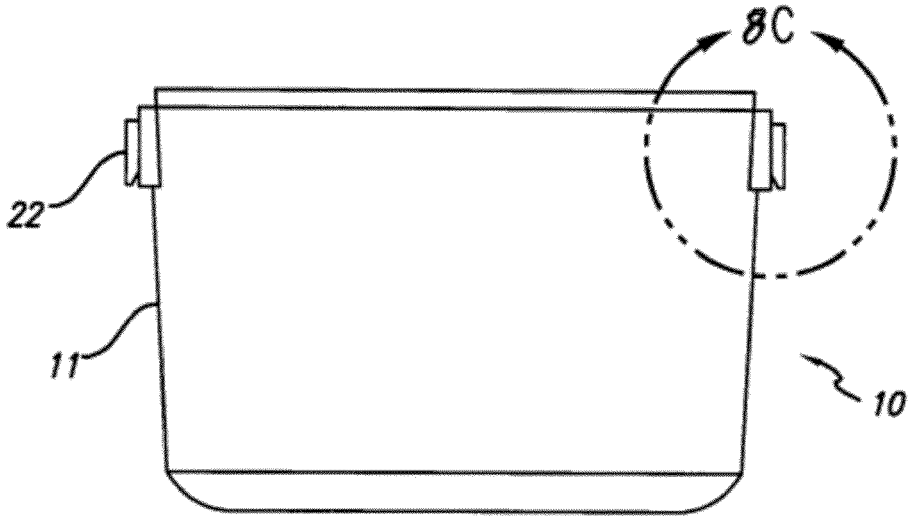
Figure 8C:
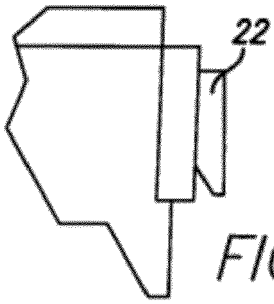

In the alternate embodiment, the tank 10 may be comprised of suitable materials known in the art, such as polyethylene, and preferably comprises non-skid feet 46 arranged in a suitable pattern to stabilize the device, such as at each corner on the outer bottom surface 48 of the tank 10 or at three points on the outer bottom surface 48 of the tank 10, as shown in FIG. 8*a*. By way of example only, In Example I, the tank 10 may be approximately 10 cm to about 200 cm high, is more preferably about 25 cm to about 150 cm high, and is most preferably between about 50 cm to about 100 cm high, or about 80 cm high. In Example I, the tank 10 is preferably about 10 cm to about 300 cm wide, is more preferably about 50 cm to about 250 cm wide, and is most preferably about 100 cm to about 175 cm, or about 148 cm wide. The tank 10 in Example I is preferably between about 10 cm to about 300 cm deep, is more preferably about 50 cm to about 250 cm deep, and is most preferably about 175 cm to about 200 cm deep, or about 150 cm deep, although other suitable dimensions may be used.

The brush frame 8 in the alternate embodiment is preferably configured so that it sits within the tank 10 above the bottom of the tank 10. This may be accomplished, for example, by way of support elements 50*a*, 50*b* disposed at the upper end of the brush frame 8 (see FIG. 5) that interface or rest upon the upper edge 27 of the tank 10, so that the brush frame is immersed in the cleaning fluid in the tank 10, but is supported above the bottom of the tank 10. In the alternate embodiment, the motor housing 6, brush frame 8 and motor, if present, together with the motor cowling 4 are preferably manufactured such that they are secured or can be fitted together. For example, in one version, the motor housing 6, the brush frame 8, and the tank 10 are preferably secured together by way of a latch catch 22, an articulating "Y-arm" 29 and a latch handle 26, although other types of suitable securing means known in the art may be used.

The latch catch 22 may be disposed on the tank 10 and the latch handle 26 may be disposed on the motor housing 6 so that the tank 10, brush frame 8, motor and motor housing 6 will be stable and secured once the latch handle 26 is in a locked position. Once secured, the interface between the motor housing 6 and tank 10 and the interface between the motor housing 6 and top cover 2 will be substantially sealed, which may be accomplished by the action of the latch handle 26, latch catch 22 and Y-arm 29 with a sealing means, such as for example, disposing an O-ring, rubberized gasket or other suitable sealing means, at each interface to be substantially sealed.

The latch handle 26 may be placed in the locked position by engaging the bottom of the latch handle 26 with the latch catch 22 and moving the latch handle in a direction that causes the articulating Y arm 29 to move from a first extended position to a second parallel position to the wall 11 of the tank 10, thereby pulling with it the latch handle 26. To lock the latch handle 26, the operator engages an end of the latch handle 26 with the latch catch 22 and applies slight pressure to the opposite end, or top, of the latch handle 26 so that the latch handle 26 moves to the parallel position, and is thereby in the locked position. To release the latch handle, the operator applies slight pressure to one end, or the top end, of the latch handle 26 to move the latch handle 26 to the extended position, which will release the opposite end, or bottom, of the latch handle 26 from the latch catch 22.

To operate the invention in the alternate embodiment, the user fills the tank 10 with water for cleaning materials such as water-base makeup. Once the tank 10 has been filled, the user then preferably lowers the motor housing 6 onto the tank 10 and locks the latch handle 26.

In a variation of the alternate embodiment, the brush frame 8 is not manufactured integral with the motor housing 6, in which case, it would be lowered onto the tank 10 prior to lowering the motor housing 6 onto the tank 10 and locking the latch handle. Preferably, the top cover 2 has already been secured in place on the motor housing 6 or motor housing unit, but the device may also be configured so that the top cover 2 is a removable component that is fitted in place at the upper surface of the motor housing 6 prior to operation of the device.

In the alternate embodiment, once the tank 10, motor housing 6, brush frame 8 and top cover 2 have been secured in place, the device is plugged into a electrical wall outlet and a power switch 52 on the device is depressed so that power flows to the motor. The user then lowers a cosmetic brush, makeup brush or other item to be cleaned into the throat opening 12 until a light tug is felt on the brush. Preferably the user strokes the brush up and down and from side to side for approximately 15-30 seconds to clean the brush. Excess water may be removed from the brush by pressing on brush groomers 54 disposed on the top cover 2. The brush groomers 54 may be comprised of ridges or protrusions integral with or secured to the top cover 2 to create a squeegee-like action on the paintbrush or cosmetic brush to remove fluid. The cleaned brushes may then be stored in an upright position for drying.

In another version of the alternate embodiment, the makeup brush, cosmetic brush, hairbrush and comb cleaning device may include a distribution manifold and jet nozzles as disclosed in U.S. Pat. No. 6,666,925, with the jet nozzles and distribution manifold being sized for the particular application and brush cleaning device dimensions. The cosmetic, makeup, hairbrush or other item to be cleaned may be positioned between the bristle portions 21 of the rotating brushes by impaling the heel brush on the jet nozzles, as described in U.S. Pat. No. 6,666,925.

In Example I, the distance between the end tips of tufts 34 of the rotating brushes 30*a*, 30*b* may be approximately 0.5 cm to about 25 cm, is more preferably 0.75 cm to about 10 cm, and is most preferably between approximately 1.0 and about 5.0 cm, or about 1.6 cm (about ⅝ inch). In Example I, the bristle portion 21 of the rotating brushes 30 is preferably configured in a spiral pattern and the distance between the spirals of bristle portion 21 is preferably between approximately 0.25 cm to about 25 cm, is more preferably 10.0 cm to about 5.0 cm and is most preferably between about 1.0 cm and about 5 cm, or about 1.3 cm to about 1.9 cm (about ½ inch to ¾ inch).

The rotating brush 30 and/or stationary brush 28 or the roller brush 76 may also comprise a spiral pattern of alternating areas of long and/or short single tufts 34, or clumps of long and/or short tufts 34. The tufts 34 of the rotating brush 30 and stationary brush 28, if present, or of the roller brush 76 may be comprised of suitable materials known in the art, such as for example, solid nylon #12 or polypropylene.

Another Embodiment of the Brush Cleaning Device (FIG. 19-25)

FIGS. 19-25 show another embodiment of an apparatus 200 for removing embedded and tangled hair from brushes; these embodiments use a power driven motor. Removing hair from brushes by hand is normally a time consuming and difficult process. This invention removes hair grooming product from the base of the hairbrush and from the teeth of the comb. There is a motor driven rotating brush (250, 255) mounted vertically in a tank or housing 205, which can contain or hold a cleaning/disinfecting solution 280; this apparatus 200 removes hair and grooming product from hair brushes and combs. The rotating brush (250, 255) can be a removable cartridge (255) that can be replaced with a clean cartridge or the used cartridge can be cleaned of hair and reinserted and recycled.

Figure 19:
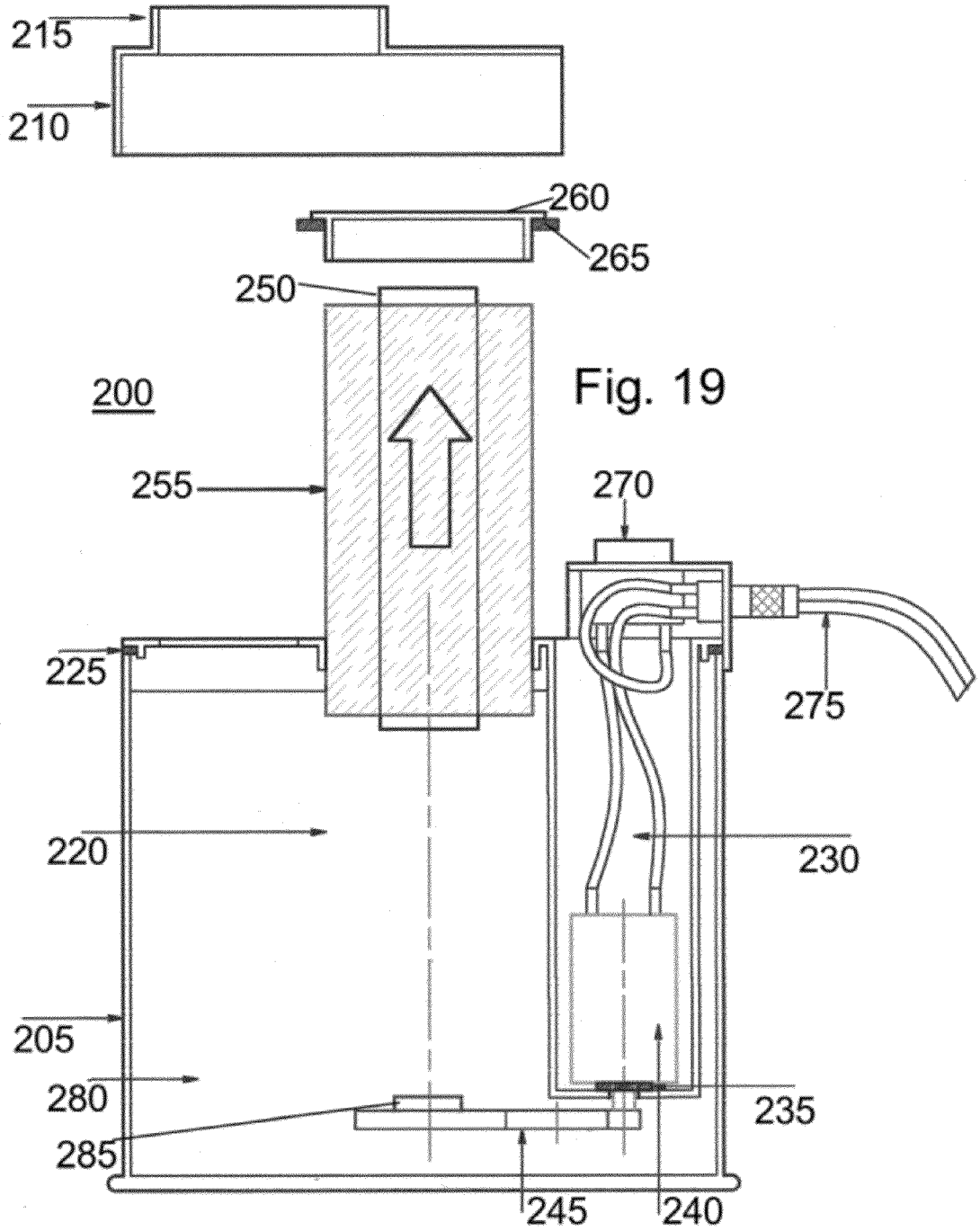
FIG. 19 is an exploded view of another preferred embodiment of the invention.

Viewing FIG. 19, there is an apparatus 200 for cleaning brushes with a housing or body with an upper and a lower end; the housing has a tank 205 for holding a cleaning solution 280 and a space for the roller brush assembly; the housing also has an area 230 for the motor 240. There is a cover 210 with a throat or throat opening 215 for the upper end of the housing. The cover also allows for access to the roller brush assembly (a brush cartridge 255 and a core 250); there is a brush cartridge access cap 260 and seal 265. The housing has a vertical axis 295; in FIG. 19, this embodiment shows the brush cartridge and core relatively central to the housing and aligned with the housing axis 295. There is a motor housing 230, a motor 240, a gear train structure 245, which connects and communicates the motor to the core and brush cartridge, an on/off activation switch 270 and a power cord 275. Note that another embodiment may employ other power sources such as batteries or a self-contained power source such as a hand crank dynamo. The tank 205 has an interior 220, and the cover can have a seal 225.

Figure 20:
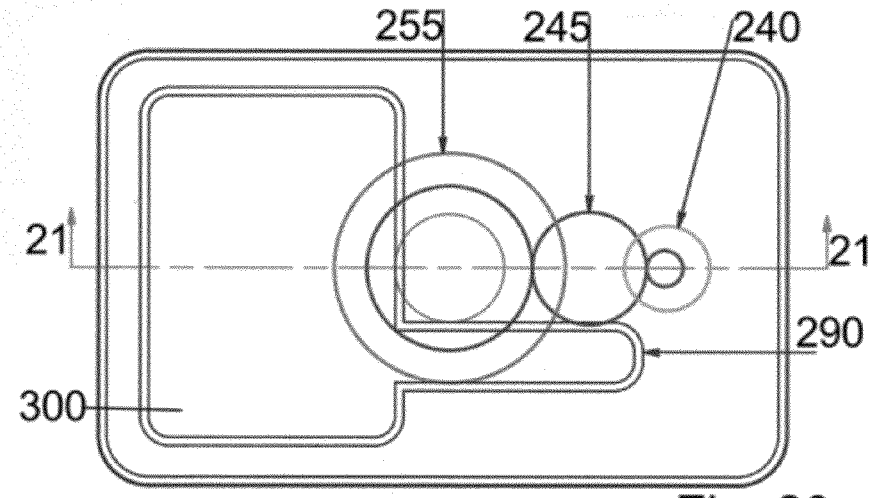
FIG. 20 is a top perspective view of another preferred embodiment of the invention.
Figure 21:
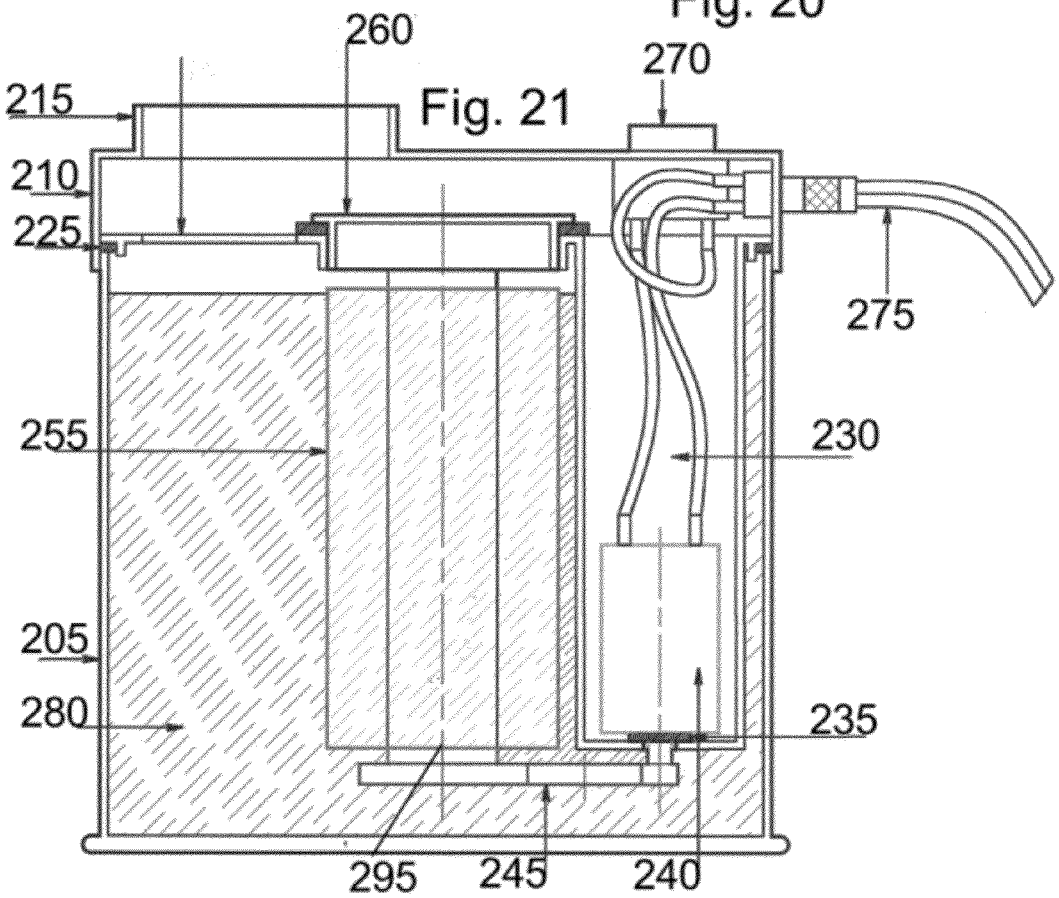
FIG. 21 is a cross-sectional view of another preferred embodiment of the invention along sight lines as shown in FIG. 20.

Operation: holding a hair brush in one hand, the user will insert the hair brush into the top opening of the machine (See FIG. 20). The spiral tuft pattern of the rotating brush pulls the brush in until it stops on the bottom of the tank. Using a loose grip on the brush handle, the hairbrush is allowed to spin against the machine's rotating brush. Combs or flat shaped combs can be inserted into a separate opening and pressed against one side of the rotating bristle brush (See FIG. 20, Ref. Part 290).

Brush Design: one preferred brush design uses a spiral pattern (FIG. 22-24); the tuft pattern on the rotating bristle brush can also use a spiral design. Similar to the Archimedes Screw principle, the spiral placed tufts pull and strip hair from the bristles of a hairbrush. The downward motion of the pattern pulls hair, cleaning solution and dirt down and away from the hairbrush.

Figure 23:
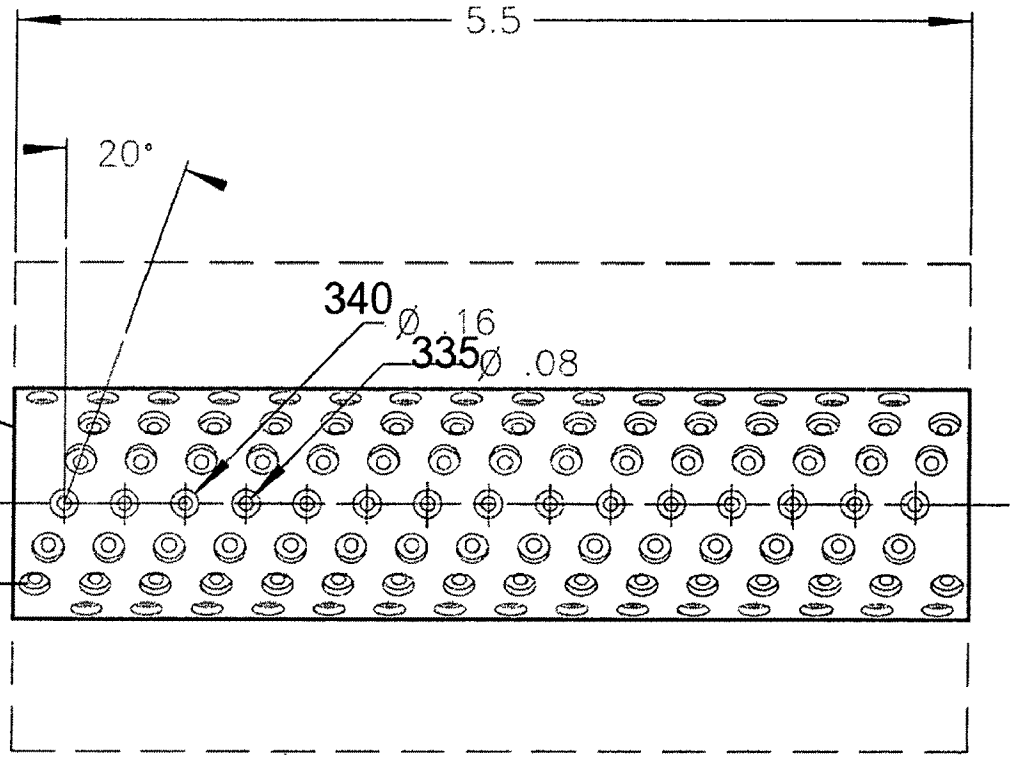
FIG. 23 is a view of another preferred embodiment of the invention, namely the rotating brush and tuft holes; the provided measurements are for example and not intended to be limiting.
Figure 22:
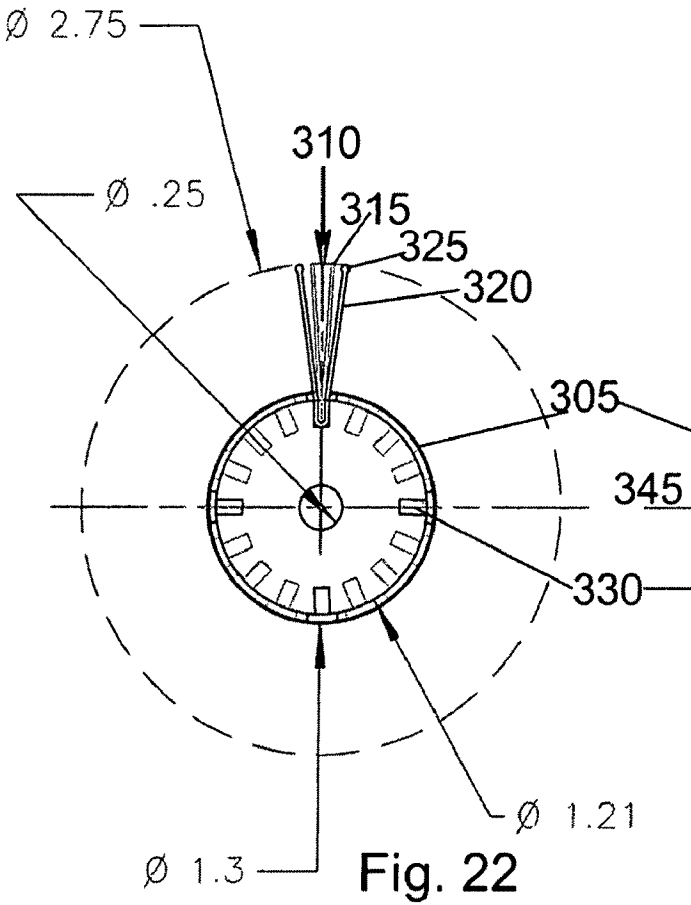
FIG. 22 is a cross-section view of another preferred embodiment of the invention, namely the rotating brush; there are some preferred measurements and dimensions shown in FIG. 22 and 23 and 24, which are not intended to be limiting. For example, in FIG. 22, each tuft may be: 32 PP (such as polypropylene) bristles 0.08 DIA.; 2 PP Bristles 0.032 DIA. Bristle Specification for one preferred embodiment: each tuft contains 32 polypropylene bristles (16 strands folded into the tuft hole) at 0.008-0.08 diameter; 2 polypropylene ball tipped bristles (1 strand folded into the tuft hole) at 0.028 diameter; ball tip diameter: 0.035 approximately.
Figure 24:
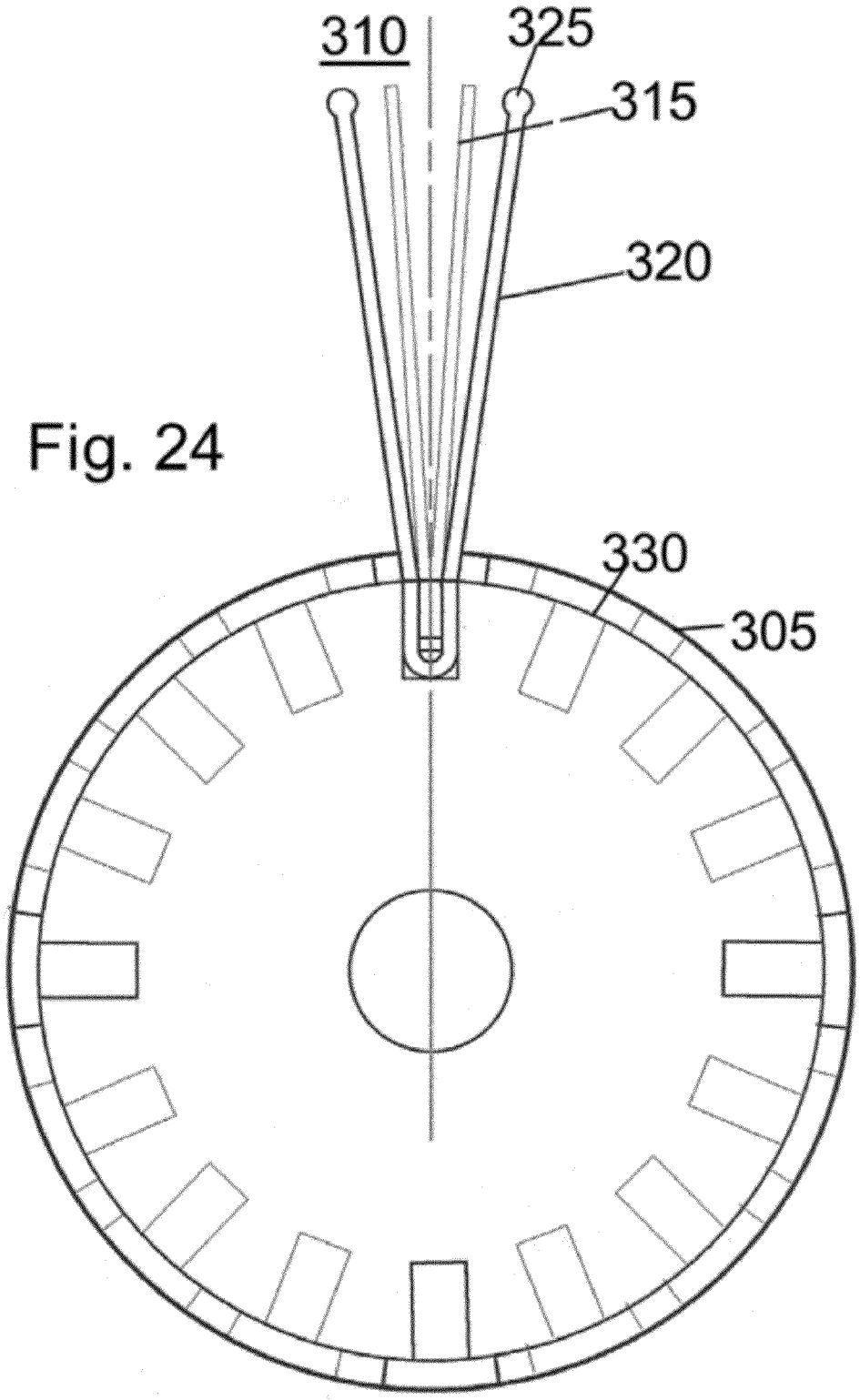
FIG. 24 is a cross-sectional view of another preferred embodiment of the invention, namely the tuft; in one preferred embodiment, each tuft can be 32 PP Bristles 0.08 DIA; moderate weave; 2 PP Bristles 0.032 DIA; tuft length can vary according to the application. These measurements are intended to be for example and not limiting.
Figure 25:
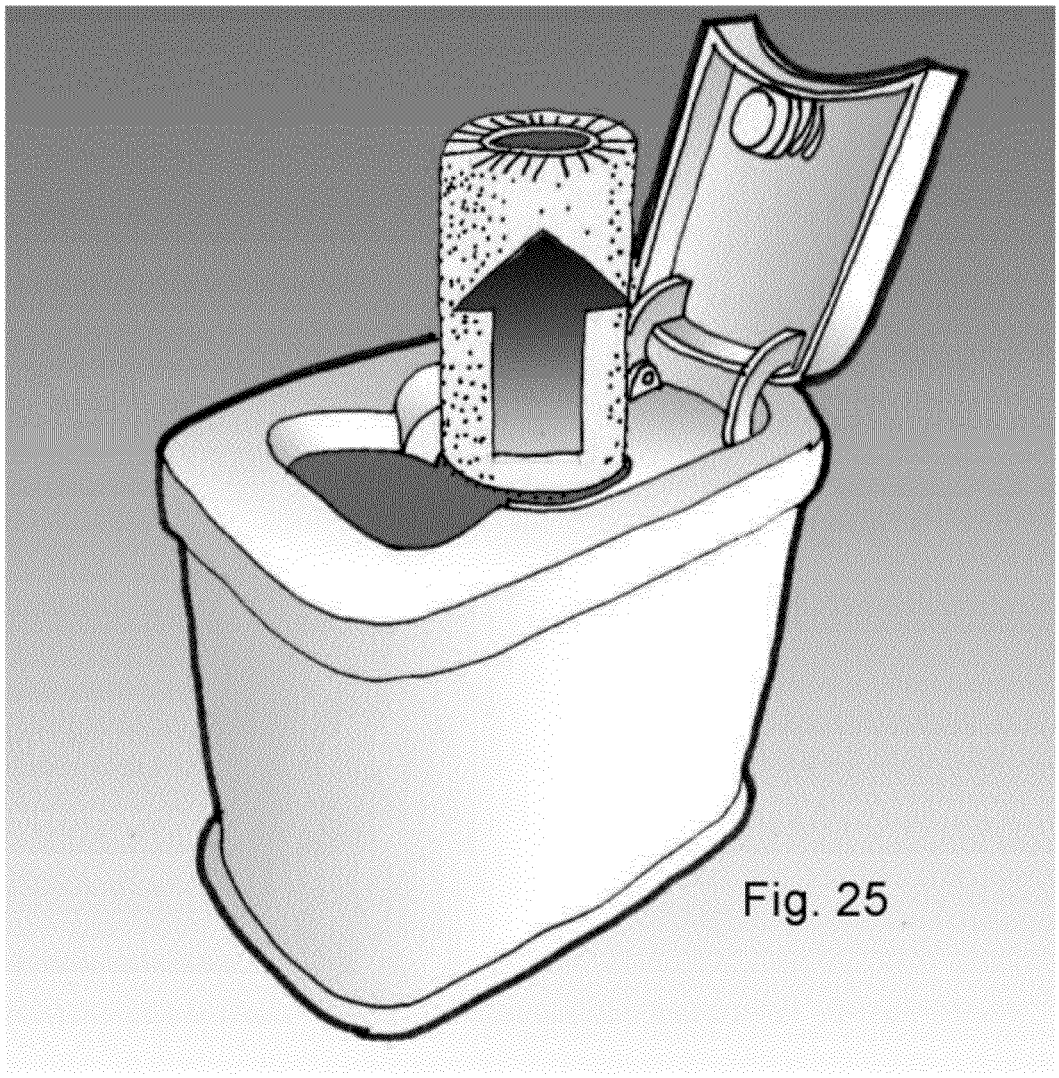
FIG. 25 is a perspective view of another preferred embodiment of the invention, which shows the brush cartridge being removed from the apparatus.

Viewing FIG. 22-24, this embodiment employs two different types of bristles in the tuft 310 and on a rotating brush 305: a first bristle type 315 (32 PP bristles (from 16 strands folded into the tuft hole); 0.08 diameter) and a second type of bristle 320 (2 PP bristles (from 1 strand folded into the tuft hole); 0.028 to 0.032 diameter). Note that the second type of bristle 320 has a ball shaped head 325 at one terminal end; the specification of the ball shaped head can be approximately 0.035.

There is at least one or multiple tuft holes or openings 330 on the rotating brush 305 or brush cartridge; there is a first type 335 of tuft hole opening (0.08) and a second type 340 of tuft hole opening (0.16). Viewing FIG. 23, the first type 335 of tuft hole opening is at a different and lower elevation in relation to the second type 340 of tuft hole opening. FIG. 24 shows one preferred way of orienting or weaving the two types of bristles in a tuft hole or opening.

Tank Configuration: the shape and volume of the tank or housing can be varied, but shape and volume can have an effect on the efficacy and efficiency of the cleaning process (to a certain extent). For example, there should be an adequate amount of space left around the rotating bristle brush to enhance the flow of cleaning solution and to carry hair and hair products away from the hair brush.

Some Other Brush Design Factors (These are Intended to be Preferred Examples and Not Limiting):

1. Spiral Pattern for the brushes and tufts of brushes;
2. Rotation: rotates so the spiral pattern is driving downward;
3. Bristle types: using a combination or mix of soft (weave shape is desirable) and rigid bristles; a first type of bristle and a second type of bristle can be used; bristle dimensions: in one preferred embodiment, the soft and stiff bristles are of equal length. However, other bristle lengths are possible. See FIG. 22 and 24 for the first type of bristle 315 and the second type of bristle 320; note that bristle 320 has a ball shaped head 325 at one end of this second type of bristle.
4. Housing Design:
   a. Material: readily available thermoplastics such ABS with UV stabilizer is recommended, but other materials, including without limit PE (polyethylene) or PP (polypropylene), can be used.
   b. Seals: rubber or synthetic rubber seals should be placed at all joining of parts. Also, special attention needs to be given to the motor seal to separate the "wet" side from the "dry" side.
   c. Component Layout: consideration needs to be given to component layouts that minimize openings between the "wet" side and the "dry" side. Alternative component layouts may move the motor up and above the water line plane so that the motor seal is not constantly immersed.
   d. Alternative Features: a separate brush cleaning apparatus being driven off the gear train may be employed for cleaning combs.
5. Rotation Speed: the rotation speed of the rotating brush can be varied; one of the inventors' prototypes operates at about 500 rpm; however, this rotation can be slowed down for optimizing the extraction of hair from the bristles of the hairbrush.
6. Sizes of hair brushes: an important design consideration is how the brush cleaning machine cleans hair brushes of varying diameter. Early prototypes used a "fence" structure that the brush butted up and against when pressed against the rotating cartridge. The distance of the fence from the cartridge should be optimized so that the fence prevents the smaller diameter brushes from jamming between the fence and cartridge. Consideration can also be given to a moving or adjustable fence that closes the gap for cleaning smaller diameter hairbrushes. Alternatively, a fixed position fence could be designed so that it has teeth extending into the cartridge which in effect would also close the gap.
7. Cleaning Solution Specifications: this cleaning solution can include herbicide, disinfectant, and a mild but effective cleaner; the cleaning solution should not be harmful to the tank, housing or seal materials.
8. Motor: in one preferred embodiment, there was a 12 v DC motor and 2500 mA transformer; the advantage to a DC motor is safety (low voltage and water); as an alternative, an AC motor and GFI (ground fault interrupter) can also be used. A high torque rating, speed (gear train) and operating motor noise are other important considerations when choosing the motor.

While the present invention has been described with regards to particular embodiments, it is recognized that additional variations of the present invention may be devised without departing from the inventive concept. The terms "a" or "an", as used herein, are defined as: one or more than one. The term plurality, as used herein, is defined as: two or more than two. The term another, as used herein, is defined as: at least a second or more. The terms including and/or having, as used herein, are defined as: comprising (i.e., open language). The term coupled, as used herein, is defined as: connected, although not necessarily directly, and not necessarily mechanically. Any element in a claim that does not explicitly state "means for" performing a specific function, or "step for" performing a specific function, is not be interpreted as a "means" or "step" clause as specified in 35 U.S.C. 112, Para. 6. In particular, the use of "step of" in the claims herein is not intended to invoke the provisions of 35 U.S.C. 112, Para. 6.

We claim:

1. An apparatus to clean brushes comprising:

a tank having closed sides and a bottom defining an interior, wherein the tank comprises a latch catch;

a brush frame disposed within the tank, said brush frame comprising lower ends and at least a first rotating cleaning means and a second rotating cleaning means, wherein, the first and second rotating cleaning means are disposed parallel to one another and each comprise a bristle portion;

a stationary cleaning means comprising a bristle portion, wherein the stationary cleaning means is disposed between the lower ends of the brush frame;

a motor housing comprising a first opening connecting to the tank and at least one latch handle;

a top cover disposed on the upper surface of the motor housing, said top cover comprising a second opening in communication with the first opening and with the tank;

wherein the latch handle interfaces with the latch catch to secure the motor housing to the tank.

2. An apparatus to clean brushes comprising:

a tank having closed sides and a bottom defining an interior, wherein the tank comprises a latch catch;

a brush frame disposed within the tank, said brush frame comprising lower ends and at least a first rotating cleaning means and a second rotating cleaning means, wherein, the first and second rotating cleaning means are disposed parallel to one another and each comprise a bristle portion;

a stationary cleaning means comprising a bristle portion, wherein the stationary cleaning means is disposed between the lower ends of the brush frame;

said stationary cleaning means having a first stationary cleaning means end and a second stationary cleaning means end; each stationary cleaning means end is secured to the bristle frame at least one point;

said stationary cleaning means serves as a structural support to the brush frame;

a motor housing comprising a first opening connecting to the tank and at least one latch handle;

a top cover disposed on the upper surface of the motor housing, said top cover comprising a second opening in communication with the first opening and with the tank;

wherein the latch handle interfaces with the latch catch to secure the motor housing to the tank.

3. An apparatus to clean brushes comprising:

a tank having closed sides and a bottom defining an interior, wherein the tank comprises a latch catch;

a brush frame disposed within the tank, said brush frame comprising lower ends and at least a first rotating cleaning means and a second rotating cleaning means, wherein, the first and second rotating cleaning means are disposed parallel to one another and each comprise a bristle portion;

a third bristle portion, which is stationary and disposed between the lower ends of the brush frame;

said third bristle portion serves as a structural support to the brush frame;

a motor housing comprising a first opening connecting to the tank and at least one latch handle;

a top cover disposed on the upper surface of the motor housing, said top cover comprising a second opening in communication with the first opening and with the tank;

wherein the latch handle interfaces with the latch catch to secure the motor housing to the tank.

4. The apparatus of claim 3 wherein said third bristle portion has a first bristle portion end and a second bristle portion end; and each said bristle portion end is secured to the bristle frame at least two points.

5. The apparatus of claim 3 wherein said third bristle portion has a first bristle portion end and a second bristle portion end; and each said bristle portion end is secured to the bristle frame at least one point.

* * * * *